US006629922B1

(12) United States Patent
Puria et al.

(10) Patent No.: US 6,629,922 B1
(45) Date of Patent: Oct. 7, 2003

(54) FLEXTENSIONAL OUTPUT ACTUATORS FOR SURGICALLY IMPLANTABLE HEARING AIDS

(75) Inventors: Sunil Puria, Mountain View, CA (US); Rodney C. Perkins, Woodside, CA (US)

(73) Assignee: Soundport Corporation, Palo Alto, CA (US)

( * ) Notice: Subject to any disclaimer, the term of this patent is extended or adjusted under 35 U.S.C. 154(b) by 0 days.

(21) Appl. No.: 09/430,213

(22) Filed: Oct. 29, 1999

(51) Int. Cl.[7] ..... H04R 25/00
(52) U.S. Cl. ..... 600/25; 381/312
(58) Field of Search ..... 381/23.1, 312, 381/205; 181/128–137; 607/55–57; 600/25

(56) References Cited

U.S. PATENT DOCUMENTS

| | | | | |
|---|---|---|---|---|
| 3,594,514 A | | 7/1971 | Wingrove | |
| 3,712,962 A | | 1/1973 | Epley | |
| 4,729,366 A | | 3/1988 | Schaefer | |
| 4,742,499 A | | 5/1988 | Butler | |
| 4,999,819 A | | 3/1991 | Newnham et al. | |
| 5,066,091 A | * | 11/1991 | Stoy et al. | 385/96 |
| 5,277,694 A | | 1/1994 | Leysieffer et al. | |
| 5,411,467 A | | 5/1995 | Hortmann et al. | |
| 5,456,654 A | | 10/1995 | Ball | |
| 5,531,787 A | | 7/1996 | Lesinski et al. | |
| 5,554,096 A | | 9/1996 | Ball | |
| 5,558,618 A | | 9/1996 | Maniglia | |
| 5,707,338 A | | 1/1998 | Adams et al. | |
| 5,729,077 A | | 3/1998 | Newnham et al. | |
| 5,762,583 A | | 6/1998 | Adams et al. | |
| 5,772,575 A | | 6/1998 | Lesinski et al. | |
| 5,800,536 A | | 9/1998 | Fisher et al. | |
| 5,804,907 A | | 9/1998 | Park et al. | |
| 5,836,863 A | | 11/1998 | Bushek et al. | |
| 5,857,958 A | | 1/1999 | Ball et al. | |
| 5,879,283 A | | 3/1999 | Adams et al. | |
| 5,897,486 A | | 4/1999 | Ball et al. | |
| 5,899,847 A | | 5/1999 | Adams et al. | |
| 5,913,815 A | | 6/1999 | Ball et al. | |
| 6,045,528 A | * | 4/2000 | Arenberg et al. | 604/28 |
| 6,050,933 A | | 4/2000 | Bushek et al. | |
| 6,153,966 A | * | 11/2000 | Neukermans | 310/328 |

FOREIGN PATENT DOCUMENTS

| | | |
|---|---|---|
| WO | WO 99/03146 | 1/1999 |
| WO | WO 99/15111 | 4/1999 |

OTHER PUBLICATIONS

Dogan. (1994). "Flextensional 'moonie and cymbal' actuators," Ph.D. thesis, The Pennsylvania State University, UMI Co.: Ann Arbor, MI, pp. 1–181.

Fernandez et al.(1996). "Hollow piezoelectric composites," *Sensors and Actators* A51:183–192.

Killion, M. C. (1997). "SNR loss: I can hear what people say but I can't understand them," *The Hearing Review* 4(12):8–14.

Letiche et al. (1993). "Great depth class V Flextensional transducer," *In Transducers for Sonics and Ultrasonics.* McCollum et al. eds., Technomic Publishing Co., Inc.: Lancaster, PA, pp. 142–149.

(List continued on next page.)

*Primary Examiner*—John P. Lacyk
(74) *Attorney, Agent, or Firm*—Morrison & Foerster LLP

(57) ABSTRACT

This relates to devices and methods for improving hearing, particularly in the field of hearing aids. The described output actuator is a component of a class of hearing devices known as surgically implantable hearing aids. This relates to both fully implanted and partially implanted hearing aids. More particularly, methods and devices disclosed herein provide an actuator for directly driving the inner-ear fluid, or the middle-ear bones referred to as the ossicular chain, resulting in the sensation of hearing.

61 Claims, 18 Drawing Sheets

OTHER PUBLICATIONS

Puria et al. (1996). "Measurement of reverse transmission in the human middle ear: Preliminary results," *In Diversity in Auditory Mechanics*. Lewis et al. eds., World Scientific: Singapore, pp. 151–157.

Puria et al. (1997). "Sound–pressure measurements in the cochlear vestibule of human–cadaver ears," *JASA* 101(5):2754–2770.

Suzuki et al. (1985). "Middle ear implant for humans," *Acta Otolaryngol* (*Sockh*) 99:313–317.

Tressler. (Aug. 1997). "Capped ceramic underwater sound projector: The 'cymbal'," Ph.D. thesis, The Pennsylvania State University, UMI Co.: Ann Arbor, MI, pp. 1–294.

Tressler et al. (1999). "Capped ceramic underwater sound projector: The 'cymbal' transducer," *JASA* 105:591–600.

Yanagihara et al. (1983). "Perception of sound through direct oscillation of the stapes using a piezoelectric ceramic bimorph," *Ann. Otol. Rhinol. Laryngol.* 92:223–227.

Yanagihara et al. (1984). "Development of an implantable hearing aid using a piezoelectric vibrator of bimorph design: State of the art," *Ann. Otol. Rhinol. Laryngol.* 92(6):706–712.

* cited by examiner

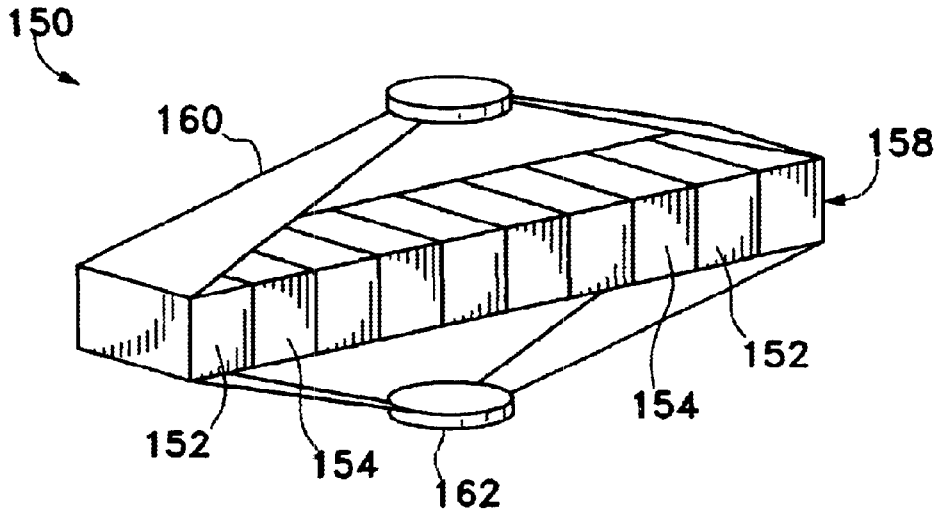
Fig. 1C
Fig. 1D
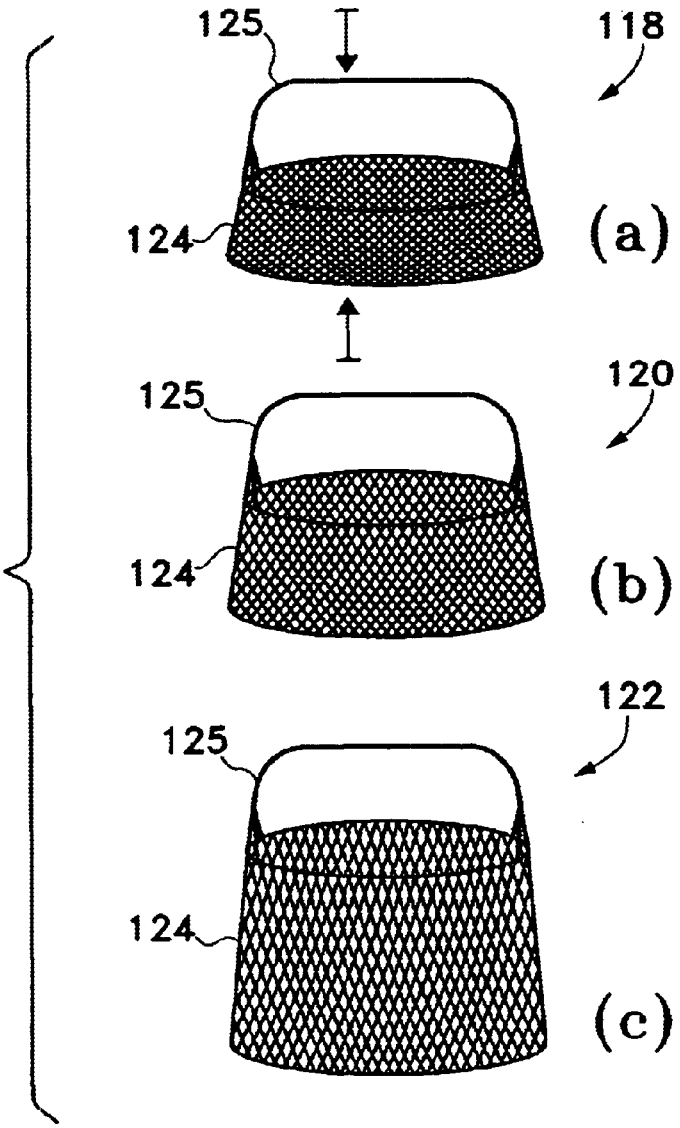

FLEXTENSIONAL OUTPUT ACTUATORS FOR SURGICALLY IMPLANTABLE HEARING AIDS

FIELD OF THE INVENTION

The present invention relates to devices and methods for improving hearing, particularly in the field of hearing aids. The invention is an output actuator that is a component of a class of hearing devices known as surgically implantable hearing aids. This invention relates to both fully implanted and partially implanted hearing aids. More particularly, methods and devices are disclosed to provide an actuator for directly driving the inner-ear fluid, or the middle-ear bones referred to as the ossicular chain, resulting in the sensation of hearing.

BACKGROUND OF THE INVENTION

Over 26 million people in the United States suffer from some type of hearing loss. A large portion of this population can regain the ability to hear or at least improve their diminished hearing with the use of a hearing aid. Yet, many people choose not to use a hearing aid for such reasons as social stigma, the discomfort associated with a device in the ear canal, the unnatural, hollow sound and/or plugged up sensation that some hearing aid users report (commonly referred to as the occlusion effect), and noise caused by feedback of the device. Surgically implantable hearing aids address all of these concerns and could increase the frequency of use by those individuals previously reluctant to use hearing aids. A detailed discussion on the usefulness and benefit of implantable hearing aids is found in U.S. Pat. No. 5,772,575 to Lesinski et al.

Like most natural processes of the body, the ability to hear is made possible by an intricate process involving many steps. The mechanical portion of this intricate process takes place in the outer ear, middle ear, and the inner ear. The outer ear, the auricle, collects sound waves and leads these waves into the middle ear. The middle ear couples the sound waves in the air-filled ear canal to fluid of the inner-ear (perilymph). The middle ear, containing the eardrum (tympanic membrane) and three tiny bones (malleus, incus and stapes), is an interface between the low impedance of air and high impedance of inner ear fluid. Pressure induced vibrations of the tympanic membrane ultimately induce a proportional motion of the stapes, the smallest of the three auditory ossicles in the middle ear. This motion is the output of the middle-ear. The stapes transmits this motion to the inner ear. In the inner ear, this motion produces a large pressure in the scala vestibuli, a perilymphatic channel on one side of the cochlear duct, in comparison with the scala tympani, a perilymphatic channel on the other side of the cochlear duct separated from the tympanic cavity by the round window membrane. The pressure difference between the two scalae in turn causes a traveling wave to move apically on the basilar membrane. The motion of the basilar membrane causes the cilium of receptor cells, also known as the inner hair cells (IHC) to move, which in turn causes firing of the auditory nerve. This process produces the sensation of hearing.

The ability to hear and the sensitivity at which one is able to hear is diminished by two basic types of ear pathologies that are commonly referred to as i) conductive hearing loss, and ii) sensory-neural hearing loss. Conductive hearing loss may be traced to either a pathological condition of the middle ear or the middle-ear cavity, or impairment (i.e., blockage) of canal or the outer ear. This type of hearing loss is routinely repaired by otologic surgeons. On the other hand sensory-neural hearing loss is due to a pathological condition of the inner ear and is nearly impossible to repair via surgery.

Different pathological conditions of the inner-ear can lead to sensory-neural impairment. See, for example, Killion, M. C. (1997) "SNR Loss: I can hear what people say but I can't understand them," *The Hearing Review* 4(12)8–14 (1997). First, there is the loss of outer hair cells (OHC), normally organized in three to four rows along the length of the basilar membrane. In this condition there is a decrease in basilar membrane motion and consequently there is a reduction in movement of the receptor cells. Most researchers agree that loss of OHC results in an increase in threshold to tonal stimuli. That is, the loss of OHC appears to reduce an individual's ability to hear quiet or low volume sounds. The loss of inner hair cells (IHC) or their cilium (hair bundles) is another disease state of the inner ear. It is believed that IHC provide all of the auditory information to the brain. Thus, in this pathological state, there is a decrease in the number of auditory nerve fibers that send neural impulses to the more central portion of the auditory system. As a result, as seen with loss of OHC, the loss of IHC results in an increase in threshold to tones. In addition, it has been speculated that loss of IHC also causes a loss of clarity of hearing. In other words, it is thought that loss of IHC results in an effective increase in internal noise and thus requires a greater signal-to-noise ratio (SNR) than patients with no IHC pathology (Killion, 1997). In this type of hearing loss there is a reduction in an individual's ability to understand speech (i.e., the signal) in the presence of background sound (i.e., the noise). By itself, any hearing aid can address the threshold issue and will improve an individual's ability to hear quiet or low volume sounds. Yet, not all hearing aids will address the signal-to-noise ratio issue—i.e., most hearing aids fail to improve one's ability to hear speech in the presence of background noise.

Two commonly found causes of sensory-neural hearing loss are presbyacusis and noise induced hearing loss. Presbyacusis is the loss of ability to perceive or discriminate sounds. This loss of high frequency hearing increases with age. Hearing is also compromised by an individual's exposure to loud sounds. For example, without hearing protection, sounds from machinery, excessive live or recorded music, gun shots, etc. cause sensory-neural hearing loss. The extent of damage depends upon the intensity, frequency, content, and duration.

Individuals having a high degree of sensory-neural hearing impairment, but who still have some residual hearing capability, can achieve normal pure-tone thresholds if the motion of the stapes is amplified. In other words, exaggerating the motion of the stapes permits a hearing impaired individual to hear sounds that were previously too soft to hear. Alternatively, driving the cochlear fluid by other means (e.g., at a location other than the stapes), and at an amplified level, also improves the ability of the hearing impaired to hear sound. Basically, the location of where cochlear fluid is put into motion does not matter. This phenomena is known as "paradoxical motion" and was described by the Nobel laureate Von Bekesey (1960). It is this "paradoxical motion" that is the basis for bone-conduction hearing which is routinely measured in audiology clinics.

Several individuals have proposed methods for directly driving cochlear-fluid. See, e.g., Yanagihara, N., Gyo, K., Suzuki, J., and Akara, H. (1983). "Perception of sound through direct oscillation of the stapes using a piezoelectric ceramic bimorph," *Ann Otol Rhinol Laryngol* 92:223; Yanagihara, N., Suzuki, J., Gyo, K., Syono, H., and Ikeda, H. (1984). "Development of an implantable hearing aid using a piezoelectric vibrator of bimorph design: State of the art," *Ann Otol Rhinol Laryngol.*; and Suzuki et al., Middle Ear Implant for Humans, *Acia Otolaryngol* (Sockh) (1985) 99:313–317. The entirety of the above references is hereby incorporated by reference. These documents describe output transducers for use in implantable hearing aids. These hearing aids rely upon a piezo bimorph. A bimorph consists of two piezo materials bonded together, sometimes having a metallic sheet (a shim) sandwiched between the piezo materials. The bimorph causes bending deformation as each piezo material produces extension or contraction under an electric field. The bonding of the two materials allows for a magnification of the displacement that is otherwise obtainable. These documents describe a piezo bimorph that is anchored to bone at one end of the bimorph. The other end of the bimorph is attached to the head of the stapes footplate. Sensation of hearing is demonstrated by applying an electrical signal to the bimorph. The functional gain achievable with a bimorph transducer depends on the length of the transducer. Because of the limited space in the middle ear, the functional gain of the Yanagihara output transducer is limited. Also, a drawback common with bimorphs includes low response speed and low generative force due to the bending mode of the materials. Although the shim increases the reliability of the piezo by maintaining structure if the piezo materials fracture, the shim adds to the size of the transducer.

U.S. Pat. No. 5,277,694 to Leysieffer et al., describes processes for driving the cochlear fluid by methods such as driving the stapes directly (as discussed by Yanagihara et al.), or by a piston through a hole made in the footplate of the stapes. At the heart of this patent is a piezo disk that sits on flexible membrane. Radial motions of the piezo causes the membrane to move, thereby causing motion of the inner-ear fluid.

U.S. Pat. No. 5,411,467 to Hortman et al. proposed an electromechanical converter. The transducer is a piezo that separates two fluid-filled chambers. One chamber has a tube that acts as a hydromechanical coupling element to the inner ear.

U.S. Pat. No. 5,772,575 to Lesinski et al. describes an actuator placed in the scala tympani through the promontory, or near the round window. In one embodiment, the transducer is fabricated from a thin circular disk of stress-biased unimorph PLZT material. This transducer is attached to a thin membrane to provide a simply supported structure and fluid-seal the entire transducer assembly. As in the Hortman et al. patent, the actuator output is coupled to the inner ear with a tube.

More recently, U.S. Pat. No. 5,707,338 to Adams et al. discusses placing a transducer on the stapes footplate itself. In Adams et al., sound is transmitted to the inner-ear fluids by flexing of stapes bone. That is, a vibration produced by the transducer causes a deformation of the footplate, thereby vibrating the inner-ear fluid. This approach causes large deformations of the footplate and resultant fractures in the footplate bone which lead to leakage of perilymph into the middle-ear cavity. Leakage of perilymph compromises an individual's ability to hear. In an another embodiment, the head of the stapes is removed thereby disarticulating the ossicles, and a perforation is made in the stapes footplate (as in a stapedotomy procedure). A bi-element transducer is then placed where the head of the stapes was cut. A rod is inserted between the footplate hole and the transducer to transmit motions of the transducer to the cochlear fluid. Disarticulating the stapes has the disadvantage of eliminating any residual natural hearing.

U.S. Pat. No. 5,772,575 to Lesinski et al., teaches the use of an implantable microactuator and implantable microphone to create vibrations in the perilymph fluid within a subject's inner ear, and U.S. Pat. No. 5,857,958 to Ball et al. teaches the use of a floating mass transducer that may be implanted or mounted for producing vibrations in a vibratory structure a subject's ear. The entirety of both patents is hereby incorporated by reference.

As shown above, many of the existing devices used for driving the stapes or inner ear fluid rely upon piezo actuators. Upon the application of an electrical potential, a piezo material expands and contracts. This is the classical electrical-to-mechanical piezo-electric effect first described by Pierre and Jacques Curie. Published in 1880, the Curie brothers were first to demonstrate the experimental connection between macroscopic piezoelectric phenomena and crystallographic structure. The most important measure of functionality of a piezo is the $d_{mn}$ coefficient that specifies mechanical motion in the n-axis for an applied E field in the m-axis of the transducer. Commonly, the $d_{33}$ coefficient is along the thickness of the transducer, while $d_{31}$ and $d_{32}$ are orthogonal to the $d_{33}$ constant. For an applied field in a given direction the sum of the displacement must be zero, since the volume of the solid must remain constant.

One limitation found in the current methods for driving the stapes or the inner ear fluid is attributable to the limit of suitable available space in the middle ear cavity. The bones of the middle ear are quite small. Likewise the middle ear cavity itself is quite small. Therefore, there exists a need to find a compact method and/or device to drive the mechanics of the middle or inner ear. Current methods to drive the ear using piezo transducers yield limited gain due to limitations on maximum applied voltages, or to physical dimensions. There remains a need for an improved hearing aid that overcomes the limitations described above.

The invention herein relates to hearing aids using a piezo in the flextensional modes to produce hearing enhancement. Flextensional transducers have existed since 1920's and have been used as underwater transducers since the 1950's. Flextensional devices typically consist of a piezoelectric element sandwiched between two specially designed metal-shell, or plastic-shell, end caps. The end caps mechanically transform the radial motion of the piezo disk into a large axial displacement normal to the surface of the end caps. The shape of the shell to a large extent determines the mechanical advantage. These transducers are described in numerous publications [eg., Tressler, Newnham and Hughes (1999), JASA 105: 591–600]. For a more thorough discussion of flextensional transducers, see U.S. Pat. No. 5,729,077 to Newnham et al., the entirety of which is hereby incorporated by reference.

As discussed in more detail below, this invention is an implantable hearing aid using a flextensional transducer. For a piezo in the flextensional modes, as described herein, the $d_{31}$ and $d_{33}$ coefficients of the piezo element contribute to an amplified displacement of the inventive transducer in the desired axial direction. The inventive transducer may drive the perilymphatic fluid of the inner-ear directly or may drive the stapes or the footplate. The substrate comprises a piezo. In the current invention, a single-crystal piezo (SCP) is preferred, but the invention does not exclude the use of other types of ferroelectric material such as poly-crystalline ceramic piezos, polymer piezos, or polymer composites.

SUMMARY OF THE INVENTION

This invention relates to devices and methods relating to implantable hearing aids for placement within a middle ear or the inner ear. In particular, the invention includes at least one output actuator comprising a piezo substrate typically having a first and a second substantially planar surfaces, a thickness, and a transverse size. The substrate changes in thickness when a voltage is applied to the material. The substrate may be, but is not limited to, a single crystal piezo (SCP). Also, the substrate may be a single layer or may be a multi-layer composite. Alternatively, the substrate may be dome-shaped.

Another variation of the invention includes a composite substrate comprising a plurality of substrate components. The substrate components are aligned such that the composite substrate has a thickness, a first and a second substantially planar surfaces, and a composite transverse size.

The output actuator also has a first end cap mounted on a planar side of the substrate, the cap having an actuating surface. The first end cap may be fixedly attached to a portion of the substrate in a manner such that a change in the transverse size of the substrate causes the actuating surface of the cap to move in a direction orthogonal to the surface of the substrate. The output actuator is generally, but not necessarily encased within a biocompatible material. The output actuator is also in mechanical communication with an auditory component of the middle ear such as an ossicle, or fluid of the inner ear.

The output actuator may also have a second end cap mounted on a planar side of the substrate opposite the first end cap. This second end cap also has an actuating surface. The second end cap may be fixedly attached to a portion of the substrate in a manner such that a change in the transverse size of the substrate causes the actuating surface of the cap to move in a direction orthogonal to the surface of the substrate.

The implantable hearing aid may also comprise output actuators which are stacked in a series. The output actuators may be placed at the incudo-stapedial joint, in which case the actuator may be an inverted cymbal design. The output actuator may have end caps having contoured shapes which accommodate or fit the incus and the head of the stapes.

Another variation of the invention includes placing an output actuator in mechanical communication with an auditory component of the middle ear. For example, an output actuator may be attached to a stapes. In this variation, the actuator may be located adjacent to the head of the stapes and to the incus. It is further contemplated that the actuator may be placed either on the footplate of the stapes or in a hole in the stapes. In another variation, the caps may be bowed towards the substrate material. As with the above variation, it is a variation of the invention to include a spacer comprising an expandable flexible portion with the output actuator.

Another variation of the invention includes placing an output actuator between an incudo-stapedial joint between a stapes and an incus. This variation may include having end caps of the actuator shaped to receive a head of the stapes and/or an incus. Another variation of this output actuator includes using an inverted-cymbal output actuator.

In another variation of the invention, the output actuator may be placed in contact with a footplate of the stapes. The actuator may also be placed in an artificial hole made in the footplate of the stapes. In such a case, the hole may be lined with a membrane that may consist of either a piece of vein, fascia, or adhesive. Another variation is that the output actuator has an end cap having a size larger than that of the hole. In such a case the larger end cap rests against the footplate of the stapes while the remaining portion of the actuator is placed within the hole in the footplate.

The output actuator may be round or of a prismatoid shape. As mentioned above, the prismatoid shape takes advantage of the anatomical configuration of the footplate of the stapes, e.g., the footplate is longer in one direction than the other. The end caps of the actuator may be made of a superelastic alloy, a metal alloy, or a polymeric material. Typically, the size of the output actuator is less than 5 mm but the actuator is not limited to this dimension.

In another variation of the invention, the implantable hearing aid may be configured to be implantable in the inner ear. It is contemplated that an output actuator may be placed directly into contact with the inner ear fluid. Alternatively, the output actuator may be placed within an assembly that has a portion adapted for rigid insertion into a bony portion of the promontory. It is another variation that the actuator may have a single or double end caps.

As noted above, the end caps of the output actuator may be made from a superelastic alloy, a metal alloy, or a polymeric alloy.

Another variation of the invention is a spacer having a mounting portion and having a shape conforming to a portion of an auditory component and a flexible portion adjacent to the mounting portion. The flexible portion has a compressed state, a natural state, and an expanded state. The spacer can expand from the natural or compressed state into the expanded state upon reaching a temperature substantially near to body temperature. The change in shape is preferably due to the use of a shape-memory alloy which expands at a temperature near the body temperature. A variation of the spacer includes a mounting portion that has a shape conforming to a portion of a stapes within the middle ear. The spacer may have a flexible portion that is configured to receive an output actuator. The spacer maybe made from superelastic or shape memory alloys.

In one variation, the spacer is positioned between the auditory component and the output actuator. Once the spacer approaches body temperature, the spacer secures the output actuator to a desired location as it expands against the output actuator.

In another variation of the invention, an ossicular attachment may be configured for attachment to an incudo-stapedial joint. In this variation the output actuator is placed between a head of the stapes and the incus. As with the other variations, the output actuator may have contoured end caps to accommodate and fit the head of the stapes and the incus.

In another variation, the implant may be configured for mechanical stimulation of the fluid within the inner ear. The implant may either directly stimulate the fluid within the middle ear or it may directly stimulate an intermediary fluid which is hydraulically coupled to inner ear fluid but separated from the inner ear fluid by a membrane.

Yet another variation of the invention includes a method of improving hearing comprising the steps of providing at least one output actuator as generally defined herein, providing a voltage to the substrate to change the traverse size of the substrate to produce a proportional movement in an actuating surface, and positioning the actuator in communication with a portion of the ear to directly transmit the movement of the actuating surface to the portion of the ear.

A variation of the inventive method includes placing the actuator in contact with a stapes, a footplate of the stapes, or a hole in a footplate of the stapes. The actuator may also be placed in contact with the incudo-stapedial joint. The actuator may also be placed in fluid communication with the fluid of the inner ear or in a vestibule fluid space.

Any of the features of one variation of the invention may be combined into or with another variation of the invention.

BRIEF DESCRIPTION OF THE DRAWINGS

FIGS. 1A, 1B, and 1C illustrates a cymbal actuator, a prismatoid actuator, and a stacked piezo, X-spring actuator respectively.

FIG. 1D illustrates a spacer for use with a actuator.

FIG. 4A illustrates a single piezo with a spacer placed in the stapes.

FIG. 4N illustrates an example of the placement of the output actuator assembly of FIG. 4K.

DETAILED DESCRIPTION OF THE INVENTION

Figure 1A:
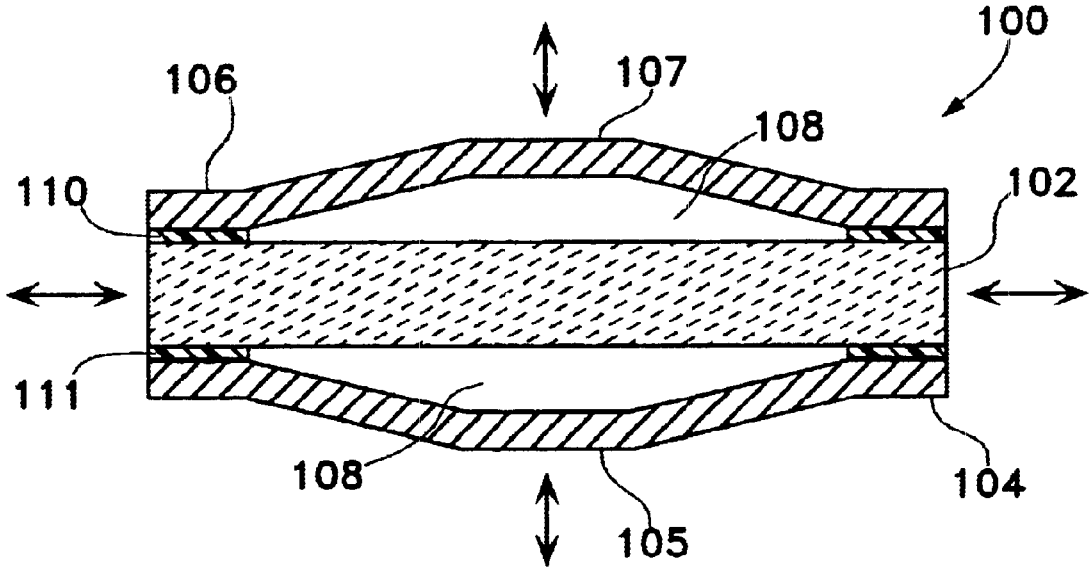
FIGS. 1A–1B illustrate two configurations of the flextensional output actuator.

The inventive device is based upon the principles of the flextensional actuator design. Specifically used is an actuator having an electro-active substrate having a pair of opposed planar or domed surfaces driving end caps. The use of flextensional principles provides significant improvements in implantable hearing aid output actuators. As noted above, available space in the middle ear cavity is limited. The use of the inventive output actuator described herein allows movement of a piezo to translate into a proportionally larger movement of the flextensional actuator. The lever action of the end caps in the flextensional devices also decreases the effective impedance of the piezo to match optimally the impedance of the body part being driven.

Another advantage of the inventive actuators is an increase in the effective piezo constants (such as $d_{33}$) that is approximately proportional to the ratio of a radial dimension of the substrate to a height of the gap between the metal and the piezo. See, Fernandez et al. (1996), "Hollow Piezoelectric Composites," *Sensors and Actuators*A51, 183–192. Using this structure, the effective $d_{33}$ of the composite may be increased by an order of magnitude or more. This increase combined with the recent discovery that SCP's have effective $d_{33}$ 3–4 times greater than any existing ceramic piezos (at low electric fields—see U.S. Pat. No. 5,804,907 to Park et al.) can result in displacements of the inner-ear fluids that are more than 30–40 times (about 30 dB) that of existing methods. Such an improved displacement of the inner-ear fluids with such a compact actuator is a significant advantage over prior known methods and devices.

Yet another advantage of the inventive device when it is used to drive cochlear fluids directly, is that the use of the inventive actuator effectively reduces the effect of feedback due to the attenuation of sound in the reverse direction from the inner ear to the middle ear. It is well known that the middle ear provides a pressure gain from the ear-canal to the vestibule. See, Puria, S., Peake, W., and Rosowski, J. (1997), "Sound-pressure measurements in the cochlear vestibule of human-cadaver ears," *J Acout. Soc. Am.* 101(5):2754–2770. It is also now known that, in the reverse direction, the middle ear does the opposite: sound originating from the inner ear is attenuated. See Puria, S., and Rosowski, J. J. (1996), "Measurement of reverse transmission in the human middle ear: Preliminary results," in Lewis et al., T., editor, *Diversity in Auditory Mechanics*, World Scientific. For some totally implantable hearing aids, placing the microphone in the ear canal reduces feedback due to the actuator because of the sound attenuating capability of the middle ear.

The substrate of the inventive actuator, when selected from piezoelectric ceramics such as PZT, PLZT, PMN, PMN-PT, has a 3 direction orthogonal to the planar surfaces and 1 and 2 directions parallel to the planar surfaces. These materials undergo a dimensional change upon the application of a voltage. The substrate itself may be a single layer or may be a multi-layer composite. The substrate typically is generally circular, although the substrate is not limited to such a configuration. In certain circumstances, the substrate may have at least one linear side, e.g., it may be rectangular. The substrate drives the actuator by causing displacement of at least one end cap that is attached to the substrate's planar surface. The end cap may be attached to the substrate through the use of a bonding agent or other similar adhesive material. When the substrate undergoes a dimensional change as a result of the application of voltage, the substrate expands in the thickness (1) direction and concomitantly contracts in the planar directions (1, 2). The relationship between the applied voltage and substrate strains are the aforementioned piezo strain constants $d_{33}$, $d_{31}$ and $d_{32}$. These contractions produce flexing of the end cap. The flexing of the end cap produces a displacement which is greater than the displacement obtainable solely by a piezo substrate.

The configuration of the end caps, to a large extent, determines the displacement amplification. Two basic types, described in more detail below, are called the "cymbal" and the "moonie". The general design of these actuators may be found, e.g., in Dogan, A. (1994). *Flextensional 'moonie and cymbal' actuators*. Ph.D. thesis, The Pennsylvania State University; Tressler, J. F. (1997). *Capped ceramic underwater sound projector. The 'Cymbal'*. Ph.D. thesis, The Pennsylvania State University; and in U.S. Pat. No. 5,729,077, to Newnham et al. A flextensional actuator called the "prismatoid actuator," also serves as an effective output actuator. This flextensional transducer, when used as an actuator, exploits the anatomical observation that the stapes footplate is longer in the anterior-posterior axis than in the other axis.

However, the invention described herein is applicable to the various configurations of flextensional actuators, not just those described above. Moreover, the drawings illustrate a single configuration of the flextensional actuator for convenience only, it is understood that the various configuration of the flextensional actuator may be used as required.

The output actuators described herein have several preferred variations. All involve using a piezo element, or a series of piezo elements, in a flextensional mode to transmit a signal to the inner ear or middle ear. In the current invention, a single crystal piezo (SCP) is described. However, the invention does not exclude the use of ceramic, polymer, or other types of piezo elements. Moreover, several types of piezo-metal or piezo-plastic composite actuators in a flextensional mode suitable for driving the inner-ear fluids, or the middle ear bones are described.

The inventive device also includes conductive electrodes which may sandwich the electro-active substrate across which a potential is applied to the substrate for actuation of the substrate. The electrodes may be independent, they may be an adhesive which affixes the end caps to the substrate, or they may be the end caps themselves. These electrodes may be metallic or a conductive polymer, or other conductive composite material. The potential applied to the substrate may be delivered from a source such as a microphone, amplifier, or signal processor.

As is noted elsewhere, the substrate preferably comprises a SCP of a solid solution of lead-zinc-niobate/lead titanate or lead-magnesium-niobate/lead titanate, described by the formulae: $Pb(Zn_{1/3}Nb_{2/3})_{1-x}\ Ti_xO_3$ or $Pb(Mg_{1/3}Nb_{2/3})_{1-y}\ Ti_yO_3$; where $0 \leqq x < 0.10$ and $0 \leqq y < 0.40$. Other especially suitable materials include ceramics such as PZT, PLZT, PMN, PMN-PT and piezoelectric polymers such as PVDF , sold as Kynar.

Turning now to the Figures, FIG. 1A shows a configuration of the output actuator (100). Here, the actuator (100) has a piezo element (102) between two end caps (104, 106) to produce a hollow space (108) between the piezo (102) and the caps (104, 106). Adhesive material (111) is used to hold the components together at points (110). The adhesive (111), preferably those sold as CRYSTAL BOND and MASTER BOND (sold by Emerson and Cuming), may also be used as the electrodes for delivering the electrical signal by including, e.g., powdered metals in the adhesive layer (111). The end caps (104, 106) are attached to the piezo element (102) at points (110). Therefore, any movement of the piezo element (102) along the indicated arrows produces a corresponding movement of the end caps (104, 106) and actuating surfaces (105, 107). For example, as the piezo element (102) extends in the direction of the arrows, the end caps (104, 106) will move towards the element (102) thereby reducing the space (108) between the element (102) and the end caps (104, 106) and moving the actuating surfaces (105, 107) accordingly. The end caps (104, 106) may alternatively be made of a plastic to reduce the actuator (100) impedance.

Also, at least a portion of the output actuator, e.g., the end caps (104, 106) or the ends of the piezo substrate (102), should be isolated from the body when implanted with a biocompatible material. Suitable materials include coatings or coverings of, e.g., titanium, titanium oxide, gold, platinum, vitreous carbon, and a number of other appropriate and known polymers. A polymeric, metallic, or composite bag of appropriate size and composition is also appropriate. Care is taken not to short-circuit the two planar surfaces of the substrate with the isolating material.

Figure 1B:
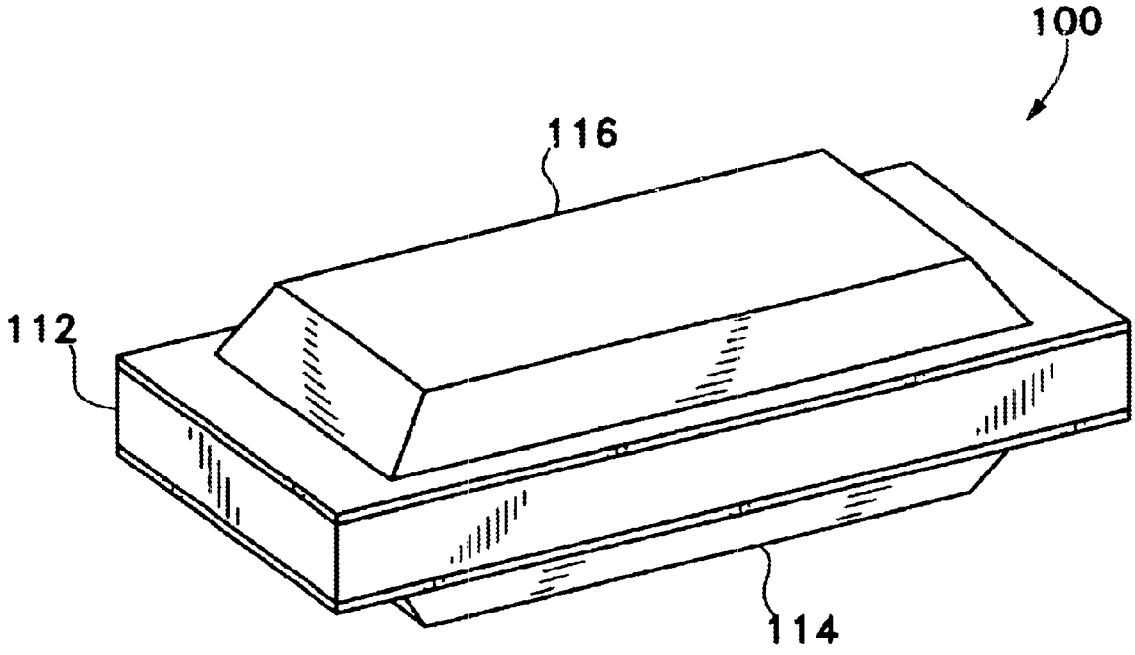

FIG. 1B illustrates a composite actuator (100) made of a rectangular piezo (112) and flexible (metal or hard plastic) end caps (114, 116). The shape of the flexible portion is that of a prismatoid and thus the actuator (100) shown in FIG. 1B is referred to as a 'prismatoid actuator'. For illustrative purposes, the prismatoid shape shown is exaggerated.

FIG. 1C illustrates another variation of the actuator. In this variation, the actuator (150) has a plurality of substrates (152) separated by complementary substrates (154). The substrates (152) and complementary substrates (154) are aligned (or horizontally "stacked") to form a composite substrate (158). Often, the polar alignment of substrates (152) is often opposite that of the complementary substrates (154) to minimize the number of electrical connections with the various substrates. The actuator (150) has a first and second end caps (160, 162) attached to the composite substrate (158). The actuator in FIG. 1C is referred to as the X-spring spacer. See, Butler et al, U.S. Pat. No. 4,742,499.

Figure 2A:
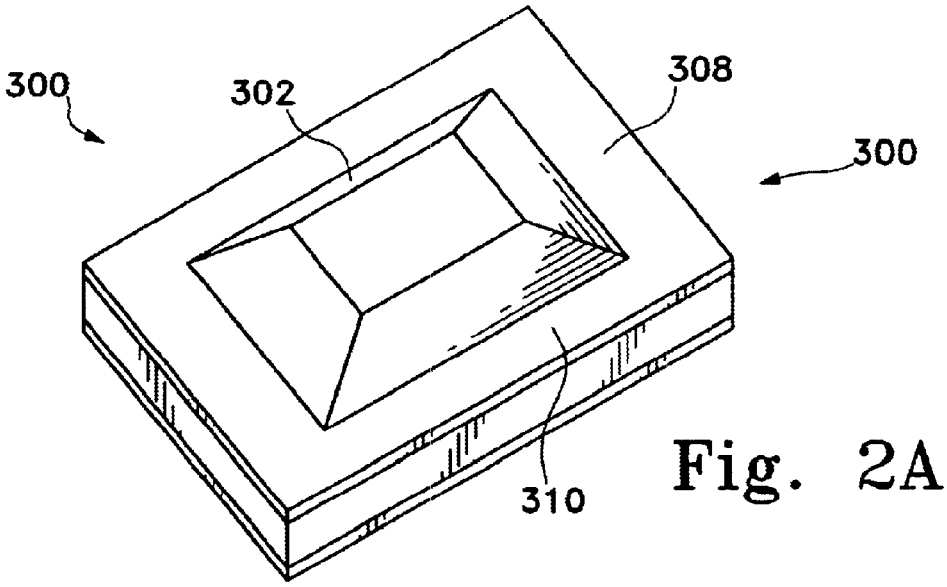
FIGS. 2A, 2B, 2C, and 2D show respectively perspective view, side view, end view, and top view of the prismatoid variation of the inventive device.
Figure 2B:
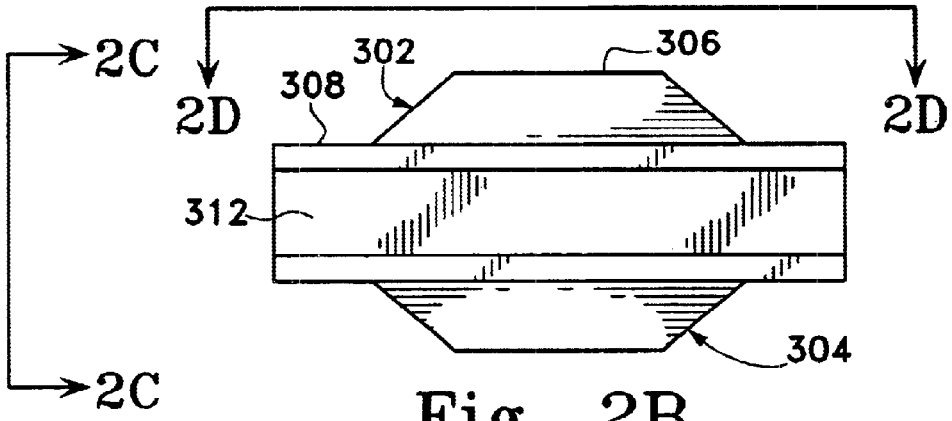
Figure 2D:
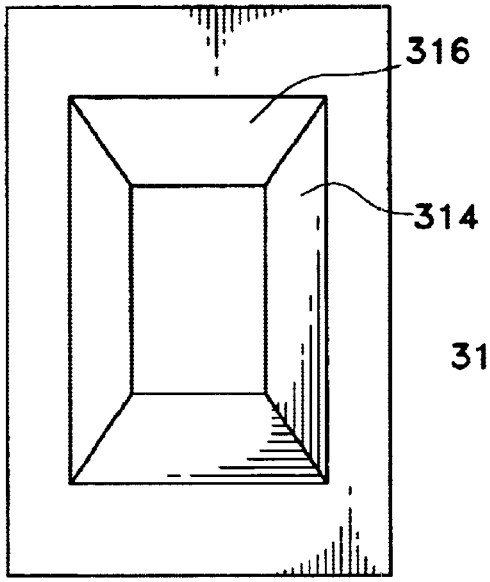
Figure 2C:
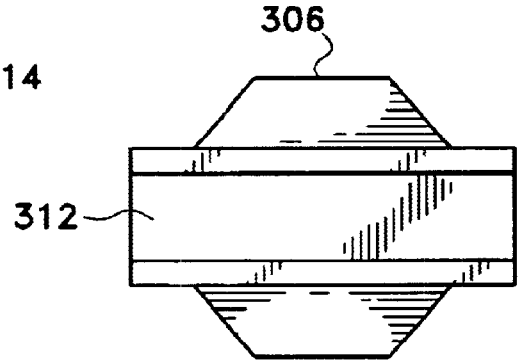

FIGS. 1D(*a*) through 1D(*c*) illustrate a variation of the inventive spacer (118, 120, 122). As will be discussed below, with regard to FIG. 2A, the spacer is introduced between the actuator and the footplate of the stapes. As shown in 1D(*a*), the spacer (118) is illustrated to demonstrate vertical forces exerted on both sides of the spacer causing a contraction of the flexible portion (124). The spacer (120) shown in 1D(*b*) illustrates the spacer in a natural state, usually at room temperature. The spacer (122) shown in FIG. 1D(*c*) illustrates the spacer in an expanded state, usually at body temperature. The flexible portion of the spacer (118, 120, 122) may be made from a shape-memory alloy. A portion of the spacer (118, 120, 122) is shaped to couple with one of the ossicular bones. For example. FIGS. 1D(*a*)–(*c*) illustrate a configuration of a portion (125) of the spacer (118, 120, 122) which fits underneath the neck and between the limbs of the stapes. Preferably, the transformation temperature $T_f$, which causes the spacer (122) to expand may be near or slightly below body temperature. Therefore, in this variation, as the spacer (118) is placed into the body, the temperature of the spacer (118) increases through conduction of heat from the body. As the spacer (122) reaches $T_f$ it expands to secure the inventive device in place.

FIGS. 2A–2D show another variation of the inventive output actuator (300) having a pair of trapezoidal closed end caps (302, 304). In this variation, end cap (302) has a planar surface of (306) and extending lips (308, 310) which adhere to the substrate (312). The end caps (302, 304) are closed and contain a volume inside. The angle of the side panels (314) and (316) may be altered to, e.g., variously maximize the size of the planar diaphragm (306) or enhance the mechanical advantage of the planar diaphragm (306) with respect to substrate (312).

Figure 2E:
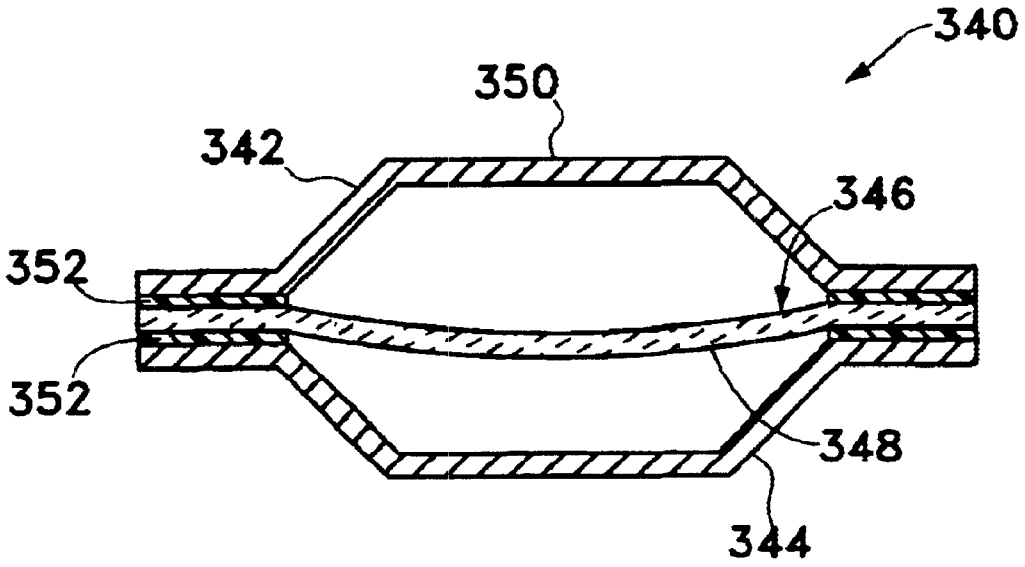
FIGS. 2E and 2F show respectively cross-section side views of variations of the inventive device having curved substrates.

FIG. 2E shows, in a cross-sectional side view, still another variation (340) of the inventive device. In this variation, the respective end caps (342, 344) are depicted to be of the "cymbal" form as discussed above. However, the end caps may be any of the end cap variations discussed elsewhere herein. The major variation from the others previously discussed is the use of a domed, perhaps hemispherical, substrate (346). The central portion (348) of substrate (346) need not be hemispherical; it may be flat as was the case with the substrates mentioned above, or it may have a shape approximating but not reaching that of hemisphericity. Substrate (346) is attached to the end caps (342, 344) using adhesive (352) or the like.

Figure 2F:
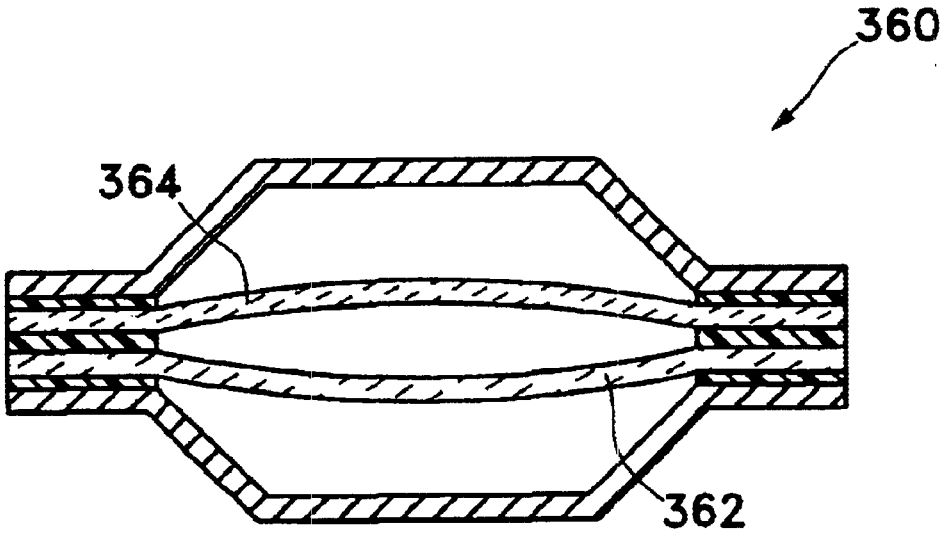

FIG. 2F shows another variation (360) of the inventive actuator. It is similar to the device discussed with regard to FIG. 2E, excepting that it has dual substrates (362) and (364). Again, these actuator substrates (362, 364) are preferably provided with a generally permanent pre-form as shown in FIG. 2F, although the shape may vary as it is mechanically excited by an electrical current introduced via the respective end caps.

Figure 2G:
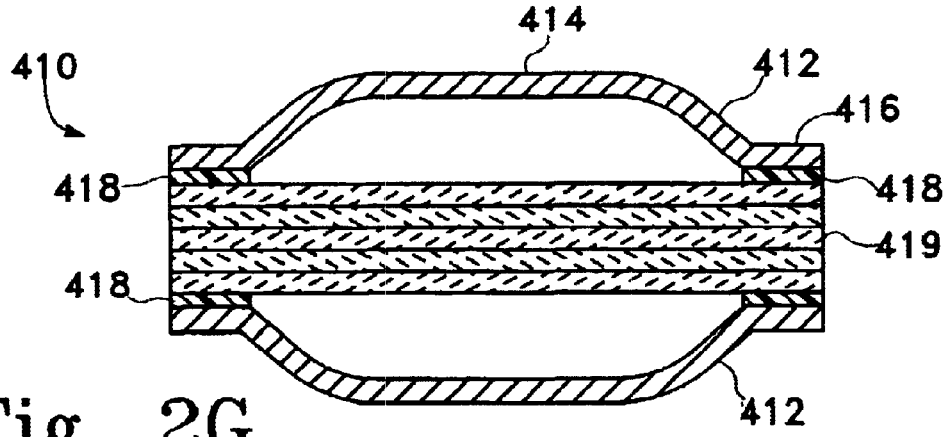
FIGS. 2G and 2H show respectively cross-section side views of domed variations of the inventive device.

FIG. 2G illustrates a cross section side view of an additional variation (410) of the inventive output actuator. A spacer lever arm (412) is between planar diaphragm (414) and peripheral lip (416). The adhesive (418) is also shown between lip (416) and piezoelectric substrate (419). It should be noted that the substrate (419) is depicted as a multi layer composite of a ceramic piezoelectric material.

Figure 2H:
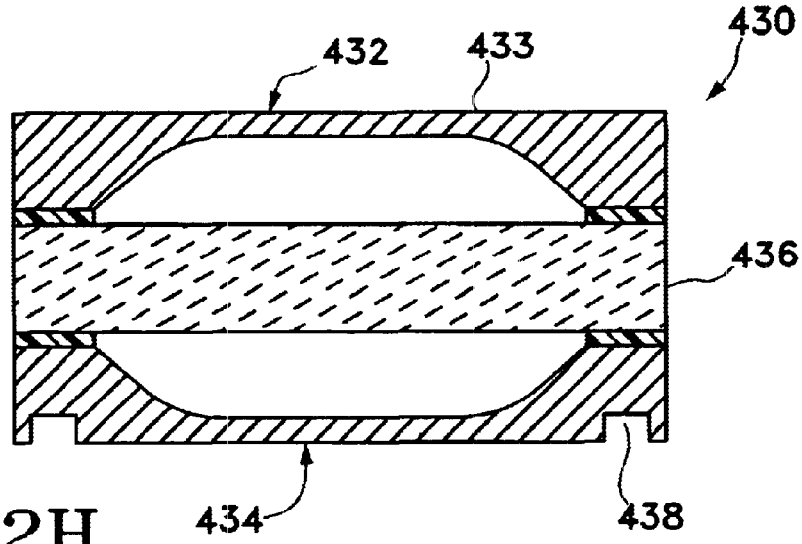

FIG. 2H shows a cross section, side view of an additional variation (430) of the inventive output actuator. In this variation, the end caps (432, 434) are of a different design. End cap (432) is a relatively solid section with a dome-shaped cavern inside adjacent the substrate (436) surface. This variation has a very large actuating surface (433). Another variation of the end cap (434) is similar to end cap (432) but has a groove (438) included for the purpose of rendering the end cap (434) somewhat more flexible than its paired end cap (432). In a single device, either of the end caps (432, 434) may have either design or both may be the same.

The actuator variations shown in FIGS. 2G and in 2H are generally referred to as "moonies."

Figure 2I:
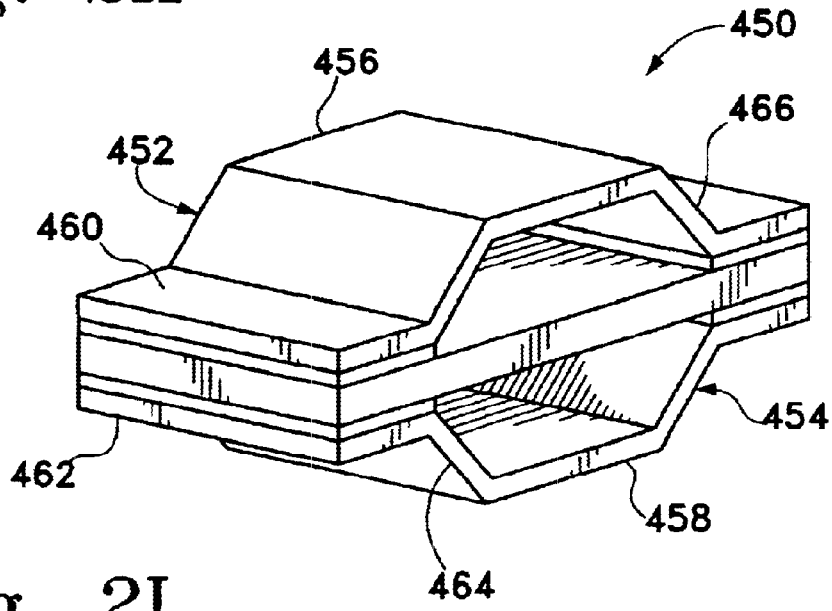
FIG. 2I shows a perspective view of a variations of the inventive device having bridge-like end caps.

FIG. 2I shows a perspective view of still an additional variation (450) of the inventive output actuator. In this variation, the actuator is rectangular, perhaps square. The end caps (452, 454) are bridge-like, and open on the sides. The respective actuating surfaces (456, 458) similarly have one or more linear sides and are separated from the adherent lips (460, 462) by spacer/lever arms (464, 466).

Figure 3A:
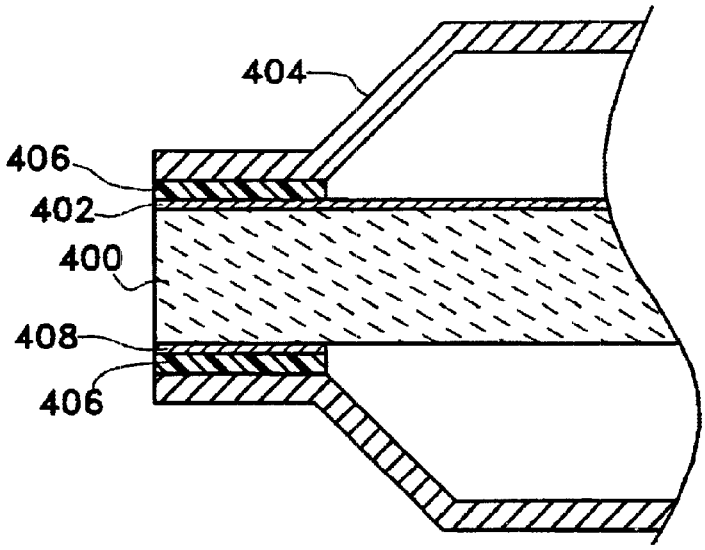
FIGS. 3A, 3B, and 3C show partial side-view cross-sections of representative methods of attaching the end caps to the substrate.
Figure 3B:
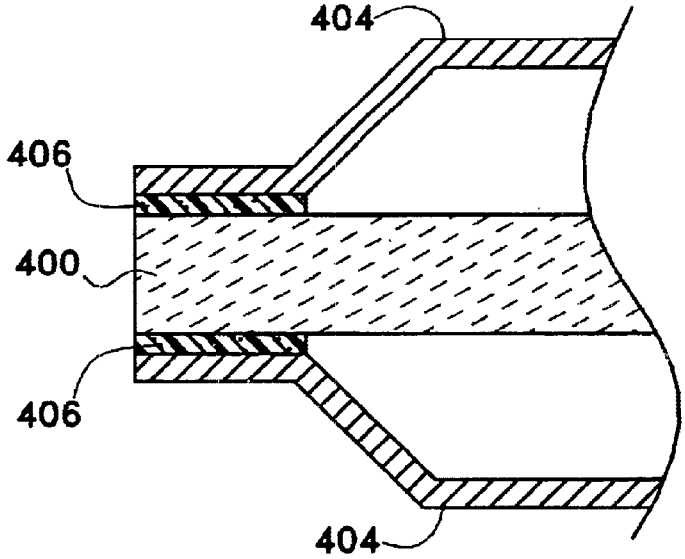
Figure 3C:
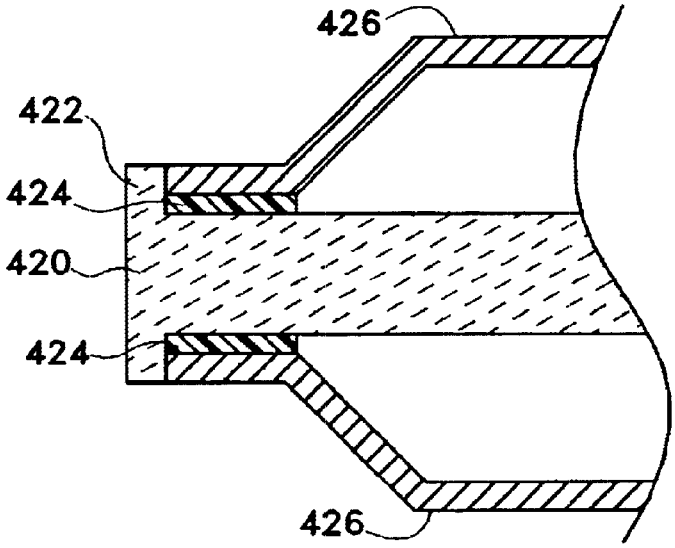

FIGS. 3A–3C all show close up, side view, partial cutaways of methods of attaching end caps to the substrate. The collection of drawings is not all-inclusive; others will be similarly appropriate. Despite our discussion below, it is usually desirable to isolate electrically, the end caps from the substrate and therefore lessen the potential for passage of the actuating voltage into other regions of the body. However, a biocompatible coating on the device itself may be used to so isolate the current-carrying portions of the device from the body.

FIG. 3A shows a variation in which substrate (400) is covered by a conductive covering (402). Conductive covering (402) may be, e.g., sputtered metal, metals, or alloy, such as a member of the Platinum Group of the Periodic Table (Ru, Rh, Pd, Re, Os, Ir, and Pt), silver, or gold. Titanium (Ti) is also especially suitable. Because of the nature of the substrates, it is often desirable to place these metals on the surface of the substrate by, e.g., sputtering, evaporation, printing, plating, or other deposition The combination of substrate (400) and conductive coating (402) is then made to adhere to end cap (404) via, e.g., an adhesive (406). The adhesive (406) may be conductive (to allow the whole side of the device to be conductive), or not (to act as a dielectric and electrically to isolate the electrode), as desired. Similarly, the end cap (404) may be used as a site for an electrical lead for that plane of the substrate (400), if such is desired. If the adhesive (406) is not conductive, the electrical signal would be taken from conductive coating (402) and coating (408).

It should be noted that although conductive coating (402) is shown to extend across the complete surface of substrate (400), it is within the scope of this invention that the applied conductive metallic layer may be limited in size, such as is depicted by layer (408). Conductive layer (408) is a ring (perhaps sputtered upon the substrate (400)). The typical assembly would typically have a pair of "complete coverage" conductive coatings (402) or a pair of annular/ring coatings (408) and not the mixture of electrode coverings shown in FIG. 3A. However, in most instances, it is not critical whether the conductive layers approach completely across substrate (400).

FIG. 3B shows a similar variation having substrate (400) and conductive adhesive (406) attaching the end cap (404) to the substrate (400). Conductive adhesive (406) may be made conductive via the use of, e.g., powdered metals or the like in the adhesive mixture, or by use of inherently conductive materials. Again, this places the ability to use either the adhesive (406) itself or conductive end caps (404) as the site for introducing the electrical signal to the piezoelectric substrate (400).

FIG. 3C shows a variation in which the substrate (420) has a partial outer lip (422) which can be used to minimize the side-to-side movement of the end caps (426) with relation to the substrate (420). Lip (422) need not be circular since the ridge may excessively clamp the lateral movement of the crystal.

Figure 4A:
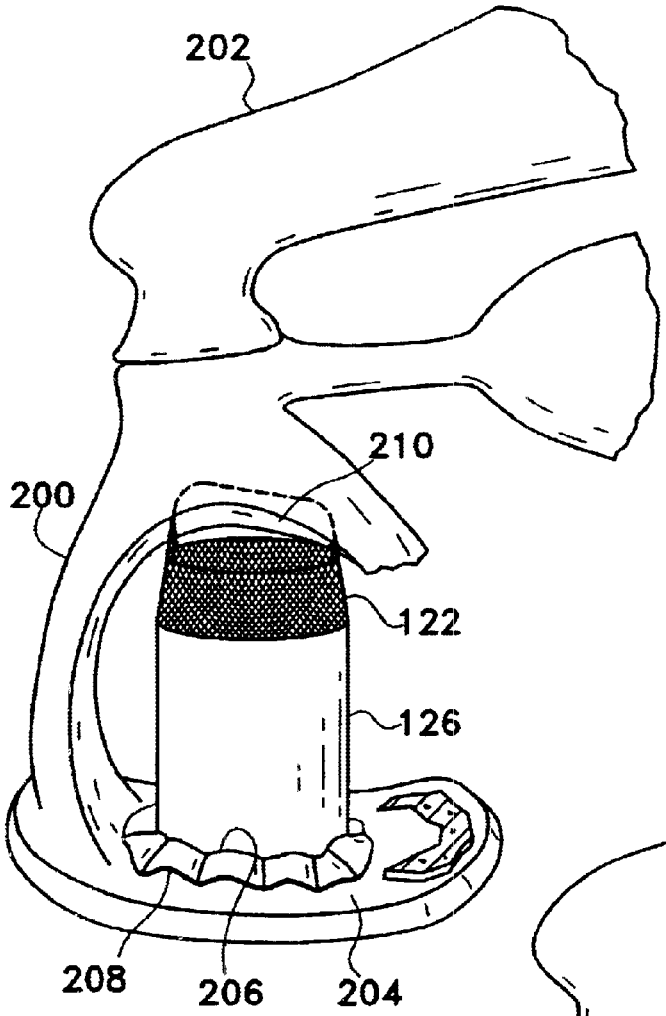
FIGS. 4A–4N illustrates various examples of placement of the output actuator.

FIG. 4A illustrates placement of a rectangular actuator (126) placed in a footplate (204) of a stapes (200). In this variation, the actuator (126) is placed in an oblong hole (206) and covered with facia or vein graft (208). The actuator (126) is inserted into the covered hole (206). A spacer (122) is interposed between the top of the actuator (126) and the neck (210) of the stapes bone (200).

Figure 4B:
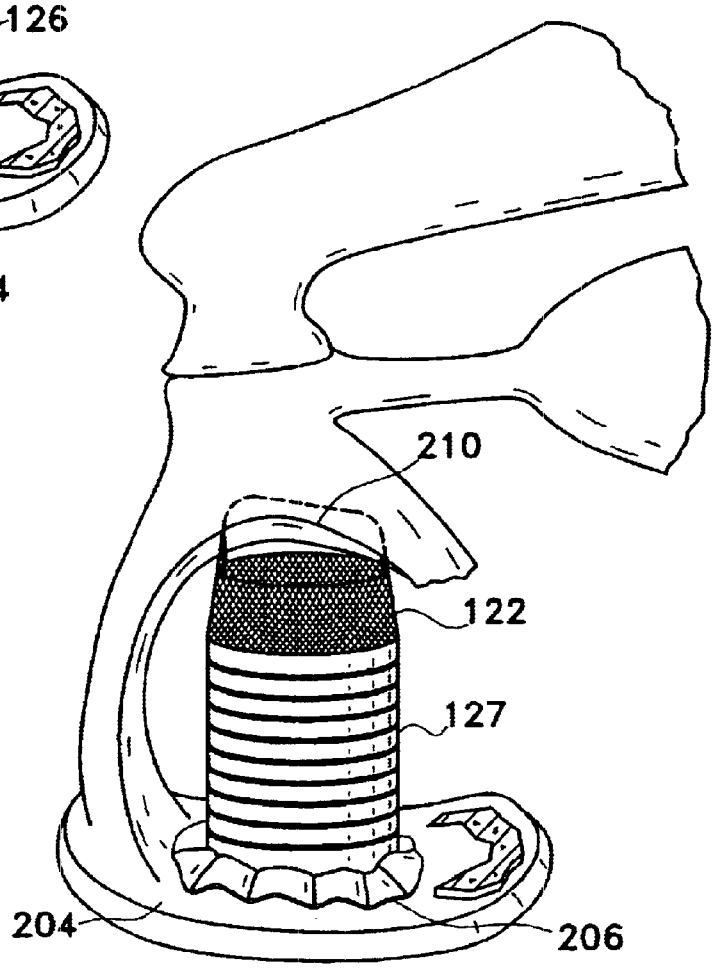
FIG. 4B illustrates a stack of piezo with a spacer placed in the stapes.

FIG. 4B illustrates another variation of the invention (127). In this illustration, the invention consists of a series of stacked actuators (127). The actuators (127) are placed in the hole (206) of the footplate (204). As in FIG. 4A, a spacer (122) is interposed between the actuator (127) and the neck (210) of the stapes bone (200).

Figure 4C:
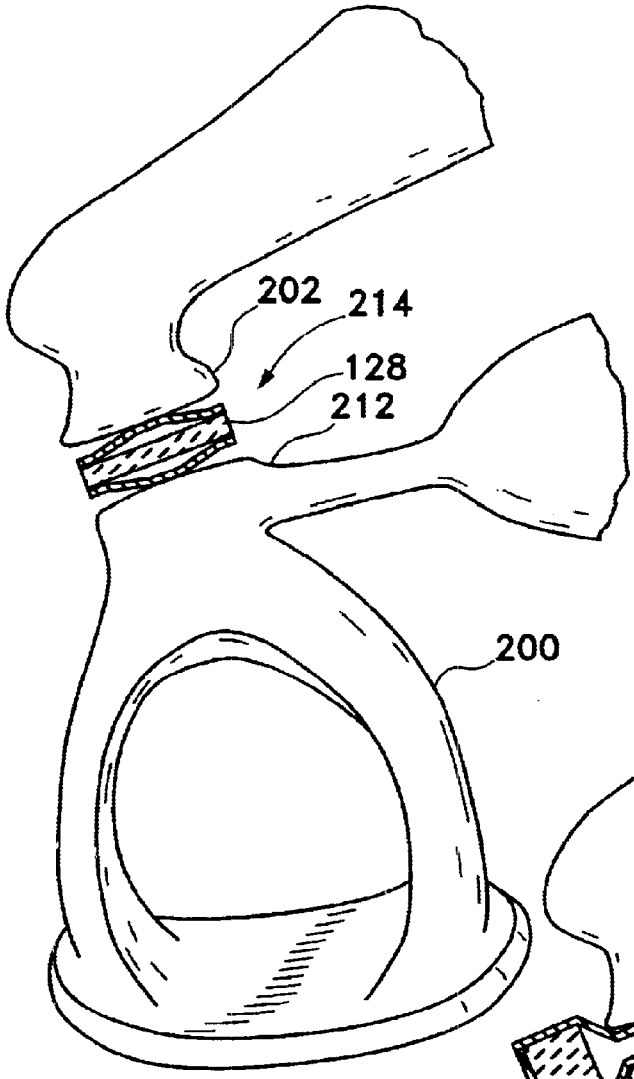
FIG. 4C illustrates a single piezo placed at the incudo-stapedial joint.

FIG. 4C illustrates an incudo-stapedial joint (214) which is separated with an actuator (128) placed in the joint (214). The restoration force of the incus (202) helps maintain the actuator in position. For long term stability of the actuator position, a soft material (facia, vein graft, adhesive, etc.) (not shown) may be wrapped around the actuator (128) and the head (212) of the stapes (200).

Figure 4D:
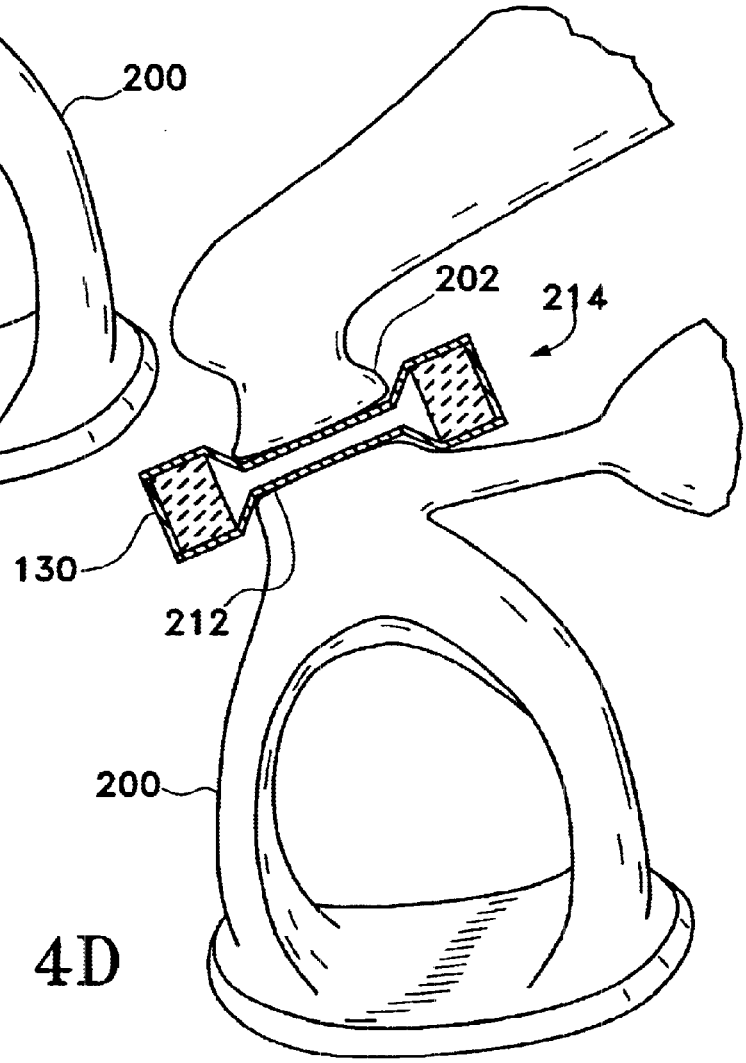
FIG. 4D illustrates a single inverted cymbal piezo placed at the incudo-stapedial joint.

FIG. 4D illustrates a separated incudo-stapedial joint (214) and an inverted-cymbal actuator (130) placed in the joint (214). For long term stability, the center of the actuator (130) may be shaped in the form of the incus (202) and the head (212) of the stapes (200).

Figure 4E:
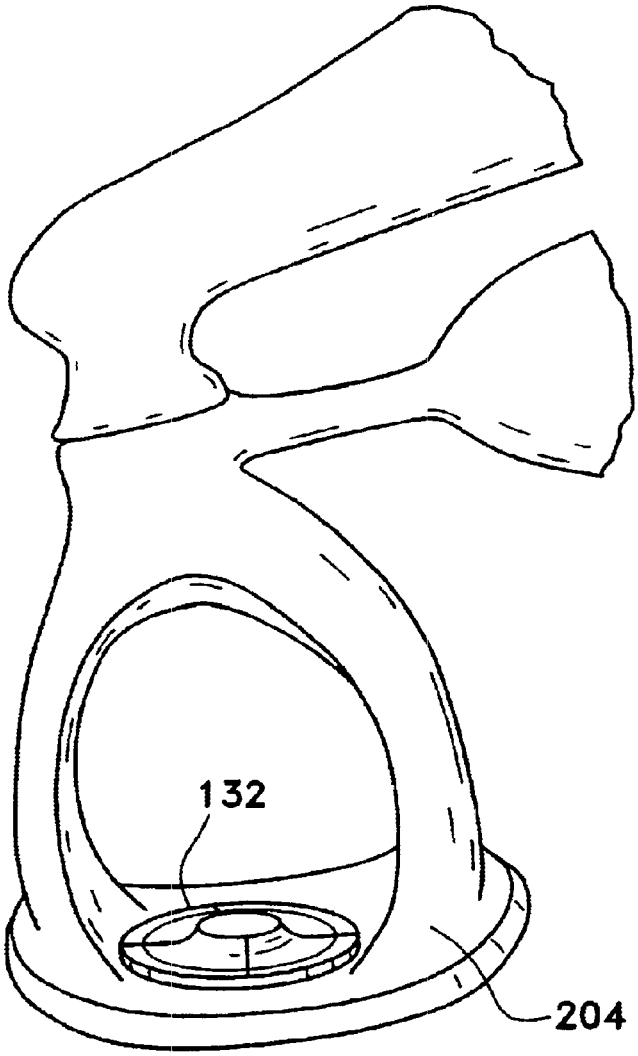
FIG. 4E illustrates a single piezo placed within a hole in the footplate of the stapes.

FIG. 4E illustrates an actuator (132) placed in a hole in the footplate (204).

Figure 4F:
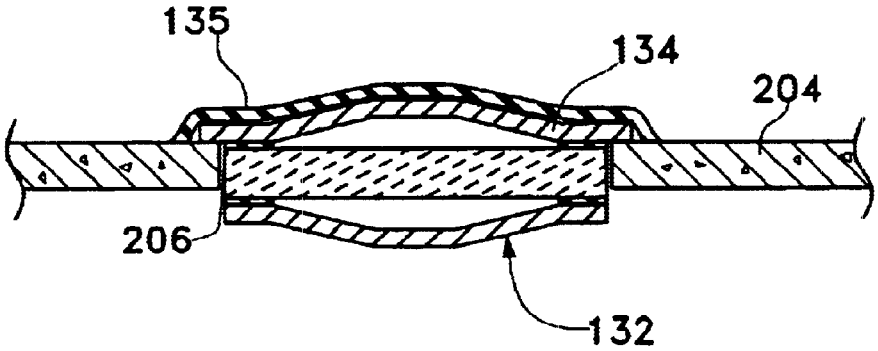
FIG. 4F is a cross sectional illustrate of FIG. 4E.

FIG. 4F illustrates an end cap (134) of the cymbal (132) which is made larger than the hole (206) in the footplate (204). This configuration prevents the actuator (132) from floating into the vestibule (not shown). As shown, a soft membrane (135), such as a piece of vein, fascia, or adhesive, may be placed over the actuator (132) to hold it in place.

Figure 4G:
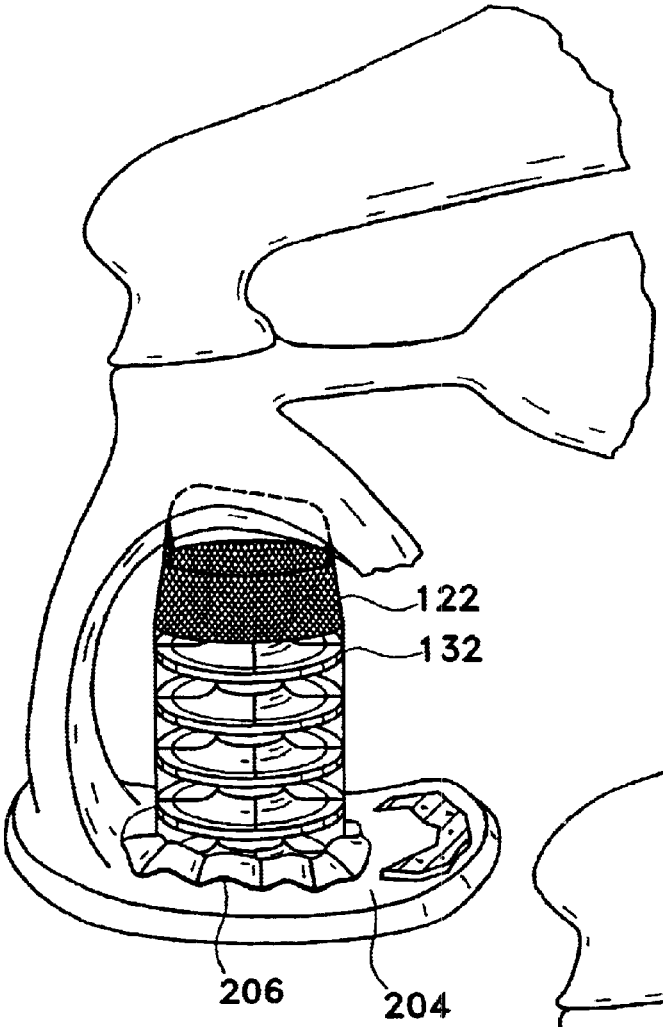
FIG. 4G illustrates a series of cymbal output actuators placed in the hole of the footplate.

FIG. 4G illustrate another example of stacked actuators. In this variation, an assembly of stacked cymbal actuators (132) is placed in a covered hole (206) in the footplate (204). In this example, a gain in displacement proportional to the number of cymbals is achieved by stacking the symbol actuators (132).

Figure 4H:
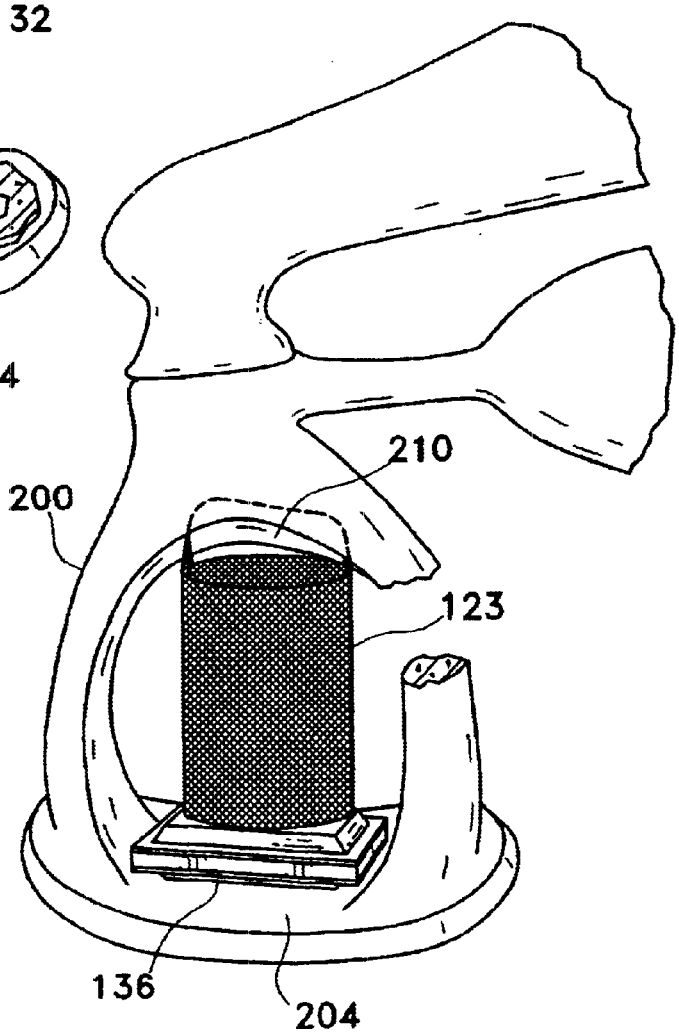
FIG. 4H illustrates a single prismatoid output actuator with a spacer placed in the stapes footplate.

FIG. 4H illustrate a variation of the prismatoid actuator shown in FIG. 1B. The actuator (136) is placed on the footplate (204) and a spacer (123) is interposed between the actuator (136) and the neck (210) of the stapes (200).

Figure 4I:
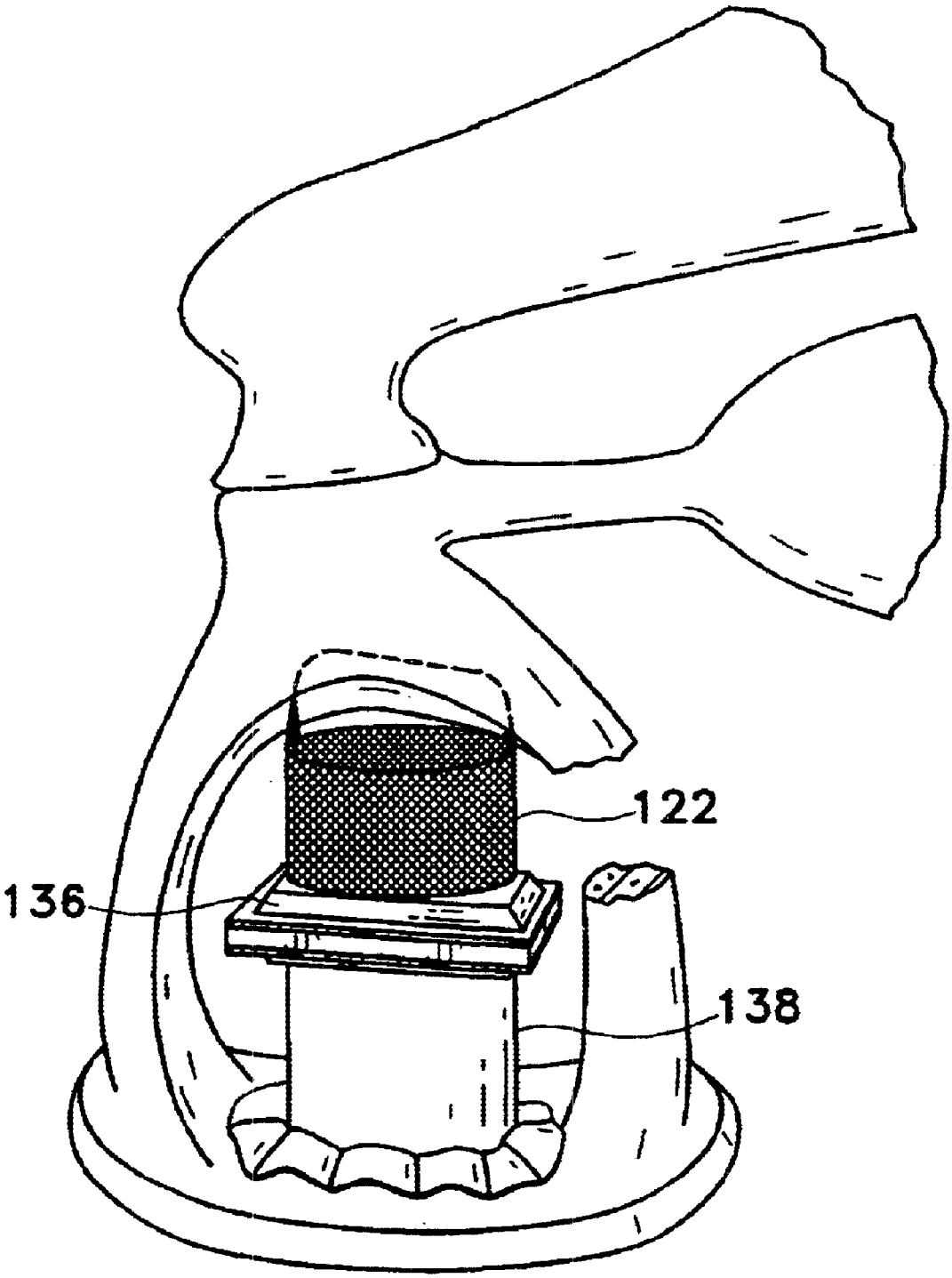
FIG. 4I illustrates a single prismatoid output actuator with a spacer and a cylinder placed in a hole of the footplate stapes.

FIG. 4I illustrates a configuration similar to FIG. 4H. However, in this example, a cylinder (138) couples the motion of the actuator (136) to the cochlear fluid (not shown).

Figure 4J:
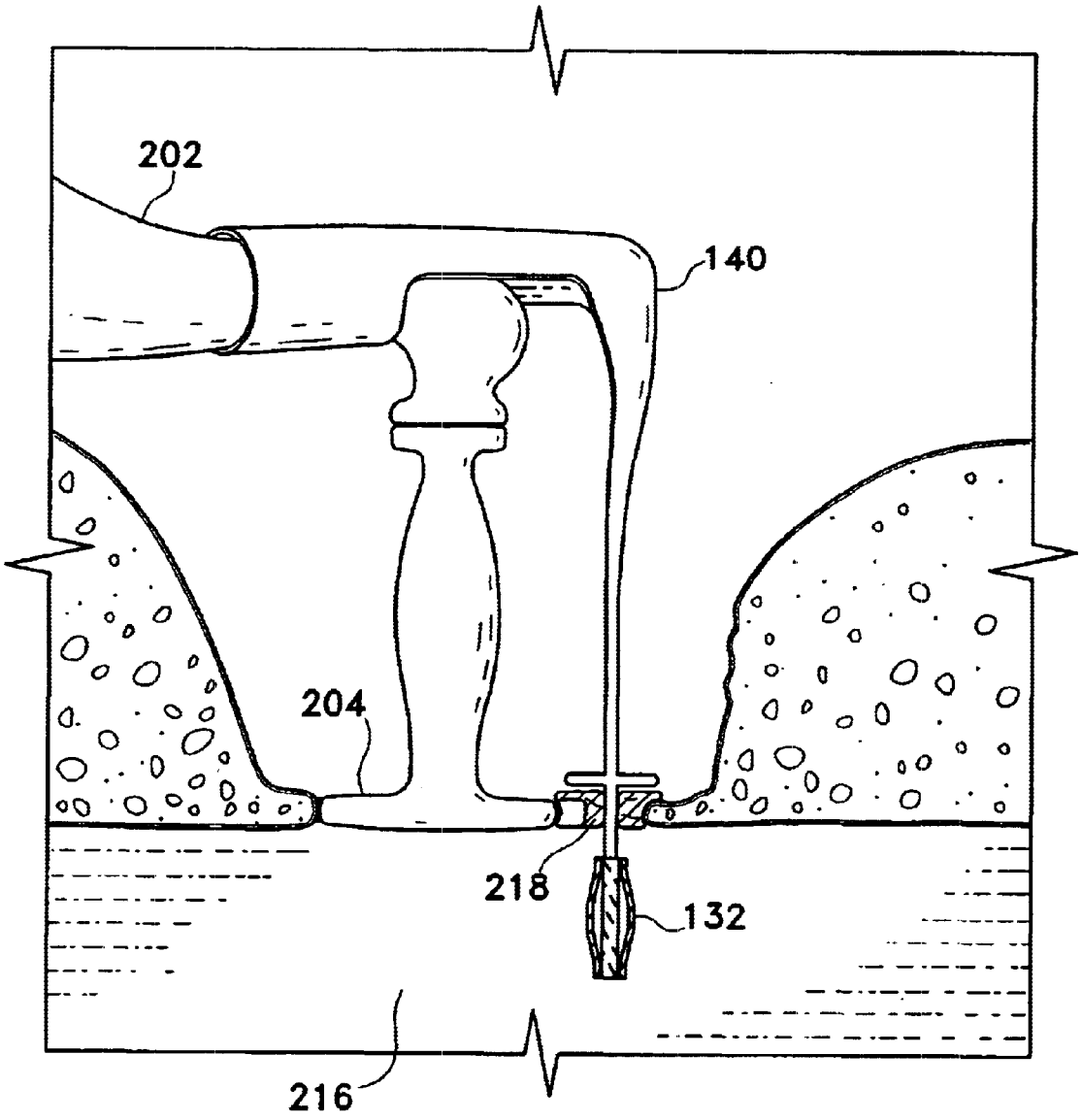
FIG. 4J illustrates an example of an output actuator placed in the vestibule fluid space and attached to the ossicles.

FIG. 4J illustrates an example of an actuator (132) inserted into the vestibule fluid space (216). The actuator (132) is held by a fixture (140) attached to the long process of the incus (202). A hole is made to the anterior side of the footplate (204), this hole allows insertion of the fixture (140). Once inserted, the hole is covered with soft tissue (218) so that the fixture (140) is mobile.

Figure 4K:
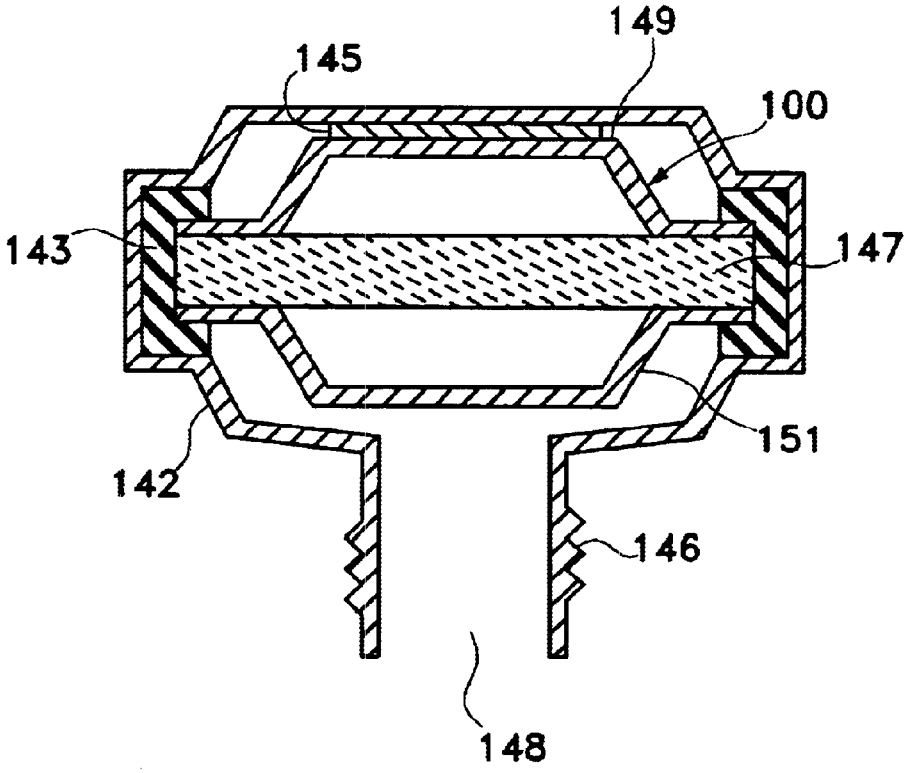
FIG. 4K illustrates an output actuator assemblies for insertion into a bony portion of the inner ear.

FIG. 4K illustrates an actuator (100) in an assembly. The actuator assembly (142) attaches to the bony part of the inner ear by means of an attachment portion (146). This attachment portion (146) may be, for example, threaded, or may have another configuration allowing for secured placement in the bony part of the inner ear. One end (148) of the assembly (142) may come into direct contact with the perilymph (or soft material that in turn drives the inner ear) while the other end may be exposed to the middle ear cavity space. The assembly shown in FIG. 4K illustrates an example of an actuator assembly with a double end cap (149, 151). The variation shown in FIG. 4K may also have a number of modifications. For instance, the mounting material (143) may simply be a dielectric, so to isolate the actuator (100) from the body. The mounting material (143) may be elastomeric or a gel to allow movement of the transducer crystal (147). Enhancement of the movement of the overall assembly (as seen at end cap (151)) may be had by utilizing a shim (145) between end cap (149) and the covering of the assembly (142). Of course, end cap (149) may adhere directly to the device end. Finally, the end cap (149) may be spaced from the end of the device.

Figure 4L:
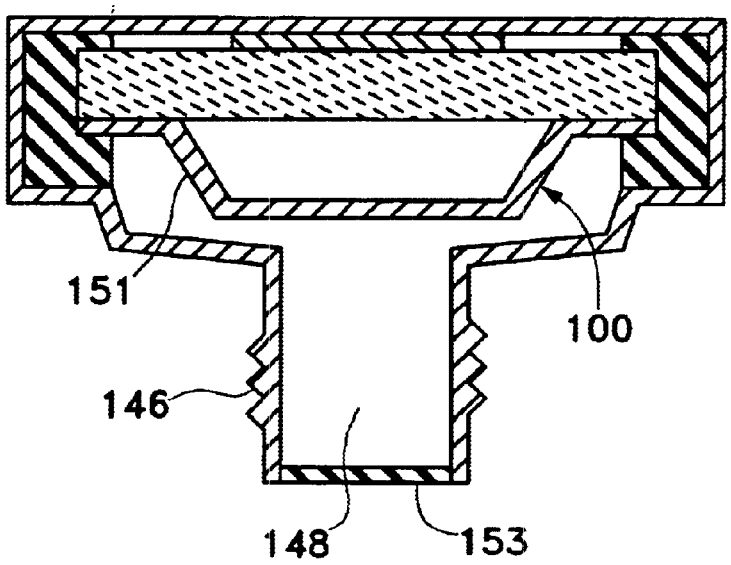
FIG. 4L illustrates another variation of the output actuator assembly of FIG. 4K.

FIG. 4L illustrates a variation of the actuator assembly of FIG. 4K. This variation comprises a single end cap (151) which reduces the assembly depth of the device. Another variation of both FIGS. 4L and 4K includes placing a membrane (153) and an intermediary fluid (not shown) within an end (148) of the assembly. In this variation, the actuator (100) will be in fluid communication with the intermediary fluid. The actuator drives the intermediary fluid which drives the membrane (153) which is hydraulically coupled to the inner ear fluid. In this variation, the intermediary fluid and output actuator (100) are kept separate from the inner ear fluid.

Figure 4M:
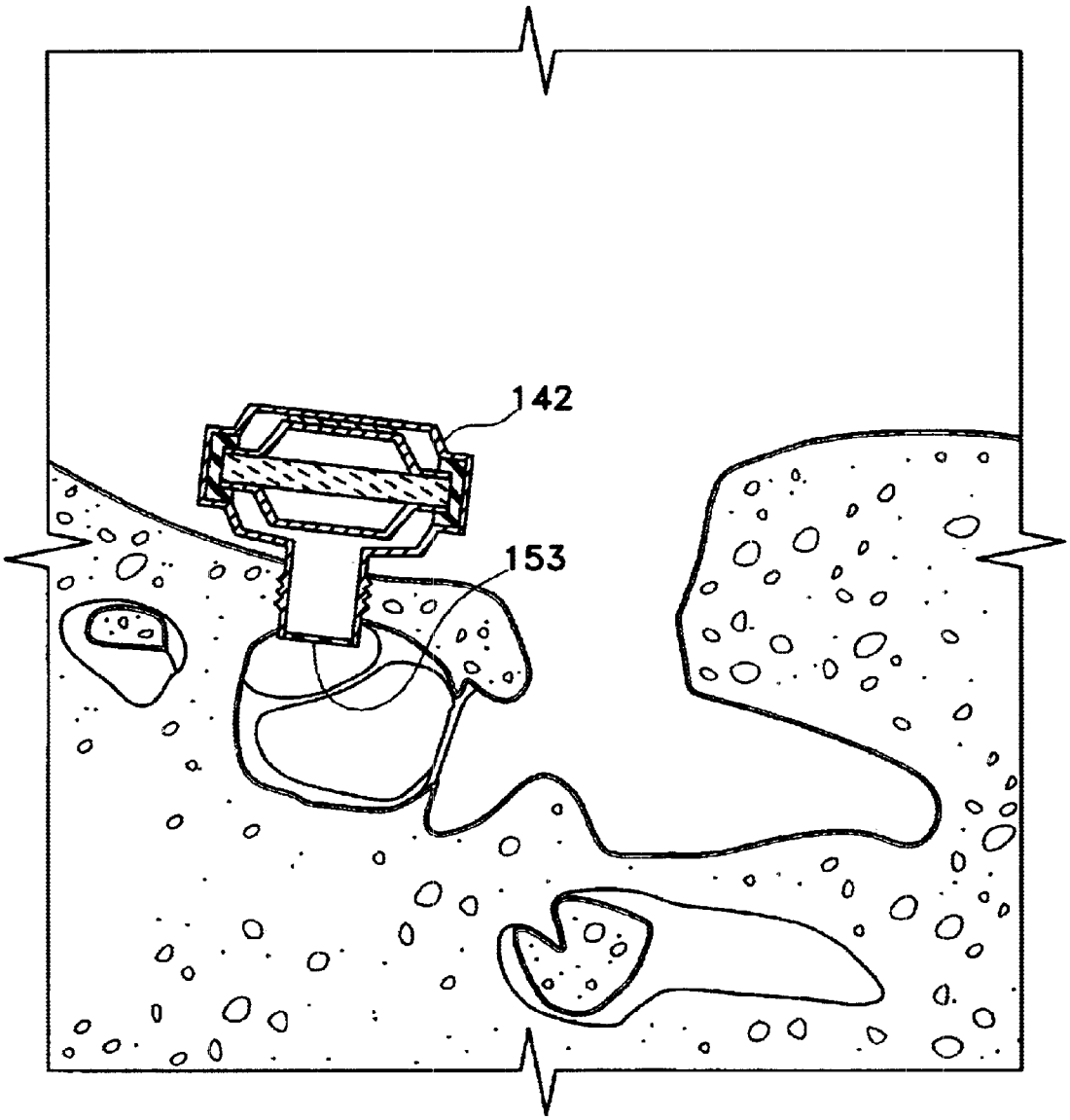
FIG. 4M illustrates an example of the placement of the output actuator assembly of FIG. 1C.

FIG. 4M illustrate an example of the assembly (142) shown in FIG. 4K. The assembly (142) is attached into the bony portion of the promontory. In the variation depicted in FIG. 4M, and as discussed above, the assembly may also comprise a membrane (153) and an intermediary fluid (not shown). In those variations without the membrane (153), the inner ear fluid may be in direct fluid communication with the output actuator (100).

Figure 4N:
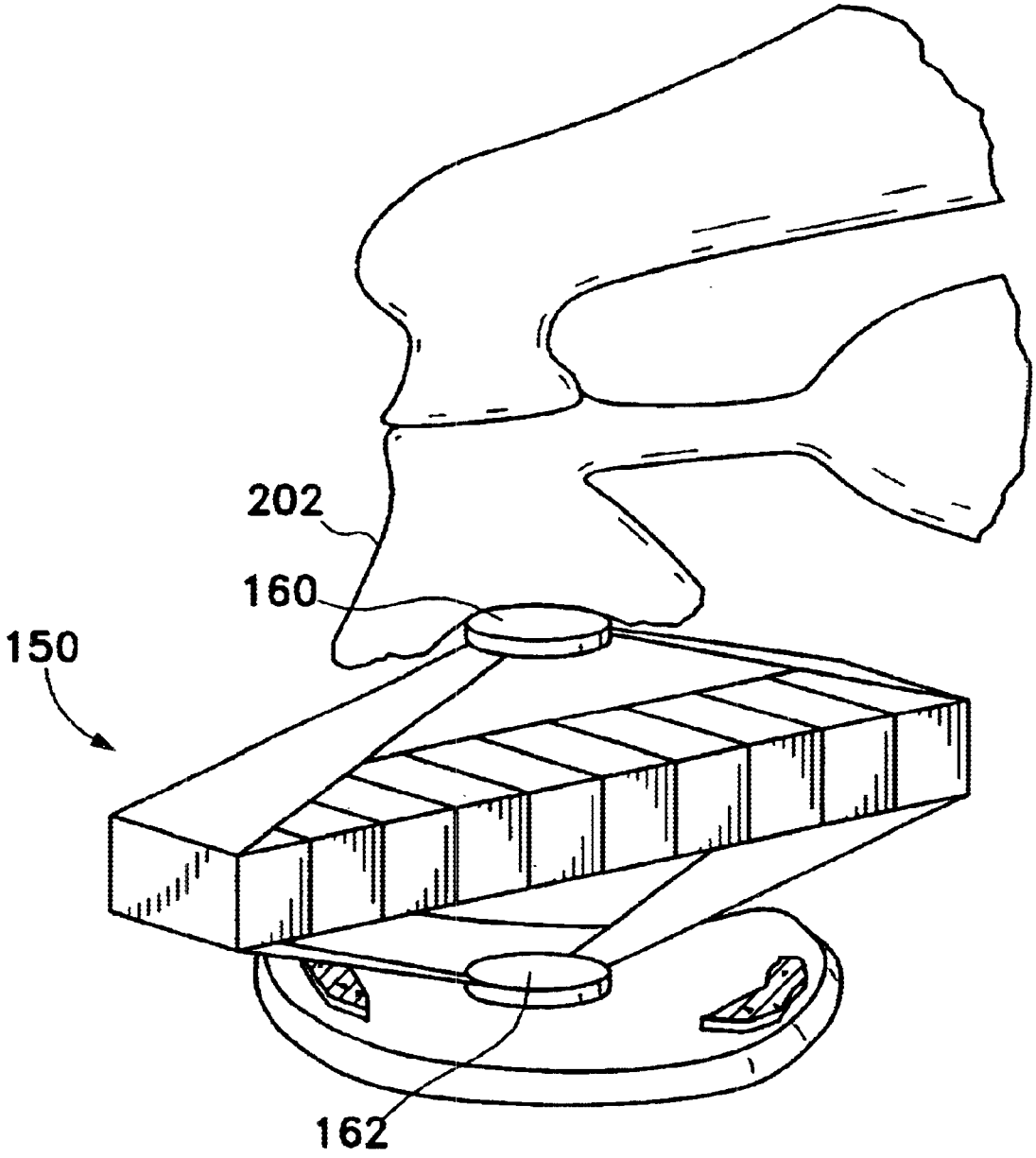

FIG. 4N illustrates placement of an X-spring actuator (150) as is shown in FIG. 1C into a stapes bone (200) which is severed. The end plates adhere to the remnants of the stapes. Other configurations of this assembly which do not require severing the stapes bone are also suitable.

Figure 5:
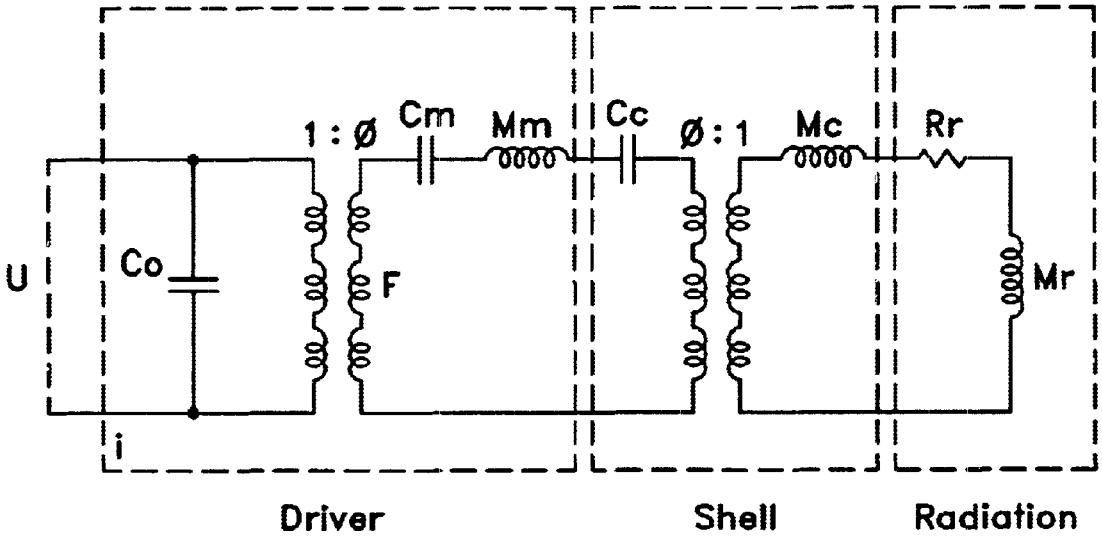
FIG. 5 illustrates an example of a circuit used to calculate the sonic output of a cymbal actuator.

FIG. 5 is an electrical circuit representation from Letiche, M. and LaScala, P. (1993). "Great depth class V flextensional actuator," McCollum, M., Hamonic, B., and Wilson, O., editors, *Transducers for Sonics and Ultrasonics, pages* 142–149. Technomic Publishing Co. This circuit is used to calculate the sonic output of the actuator. The parameters of the model, including transformer lever ratio $\phi'$, depend on the dimensions of the piezo, dimensions of the shell end caps, and the material properties of the shell end caps.

Figure 6A:
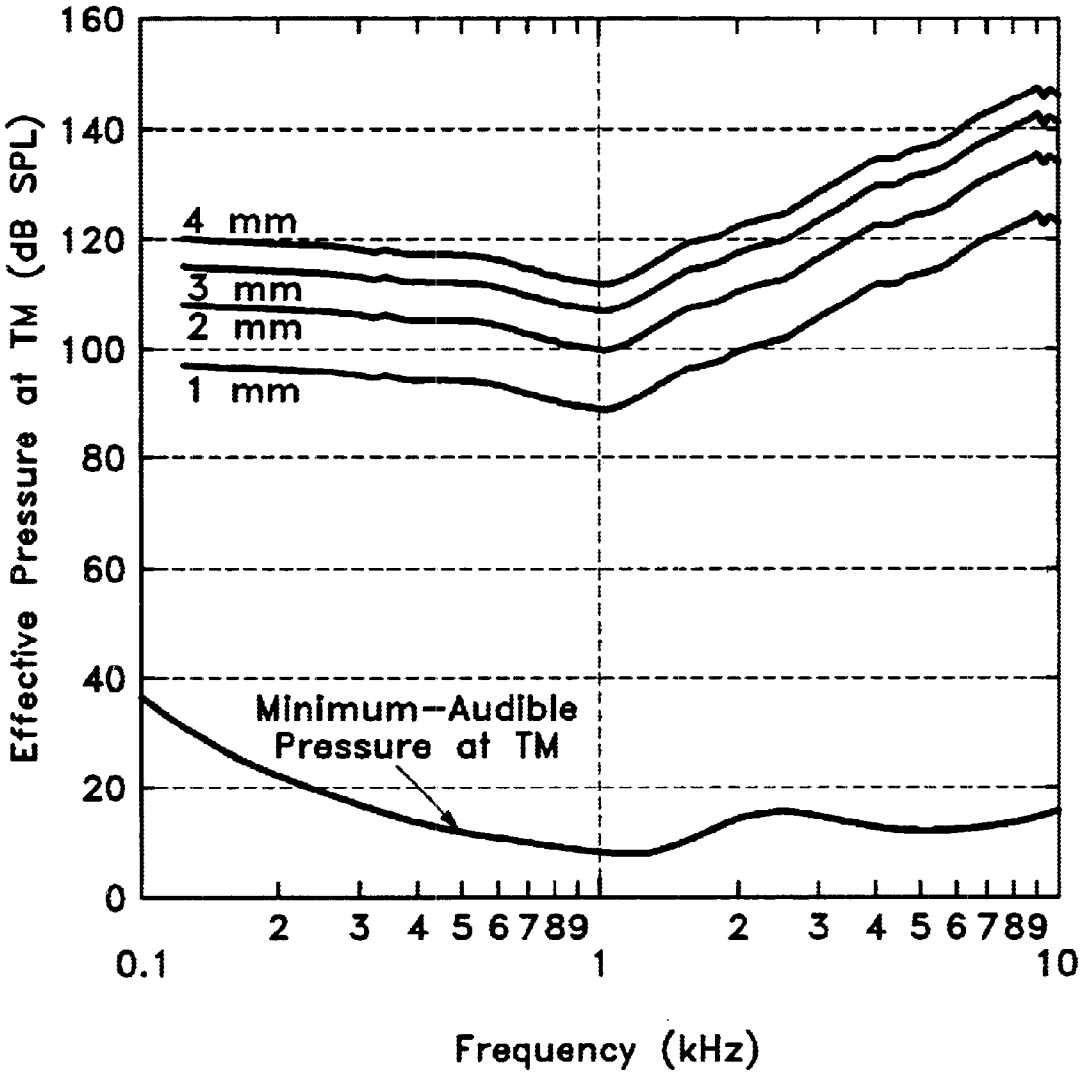
FIGS. 6A–6B illustrate data from model calculation of the circuit shown in FIG. 5.

FIG. 6A is a chart of effective sound pressure level at the tympanic membrane for cymbal in ISJ. The piezo is PZT5H and the shell is titanium. Calculations are shown for 31 volt stimulus. The parameter shown is the diameter of the cymbal actuator.

Figure 6B:
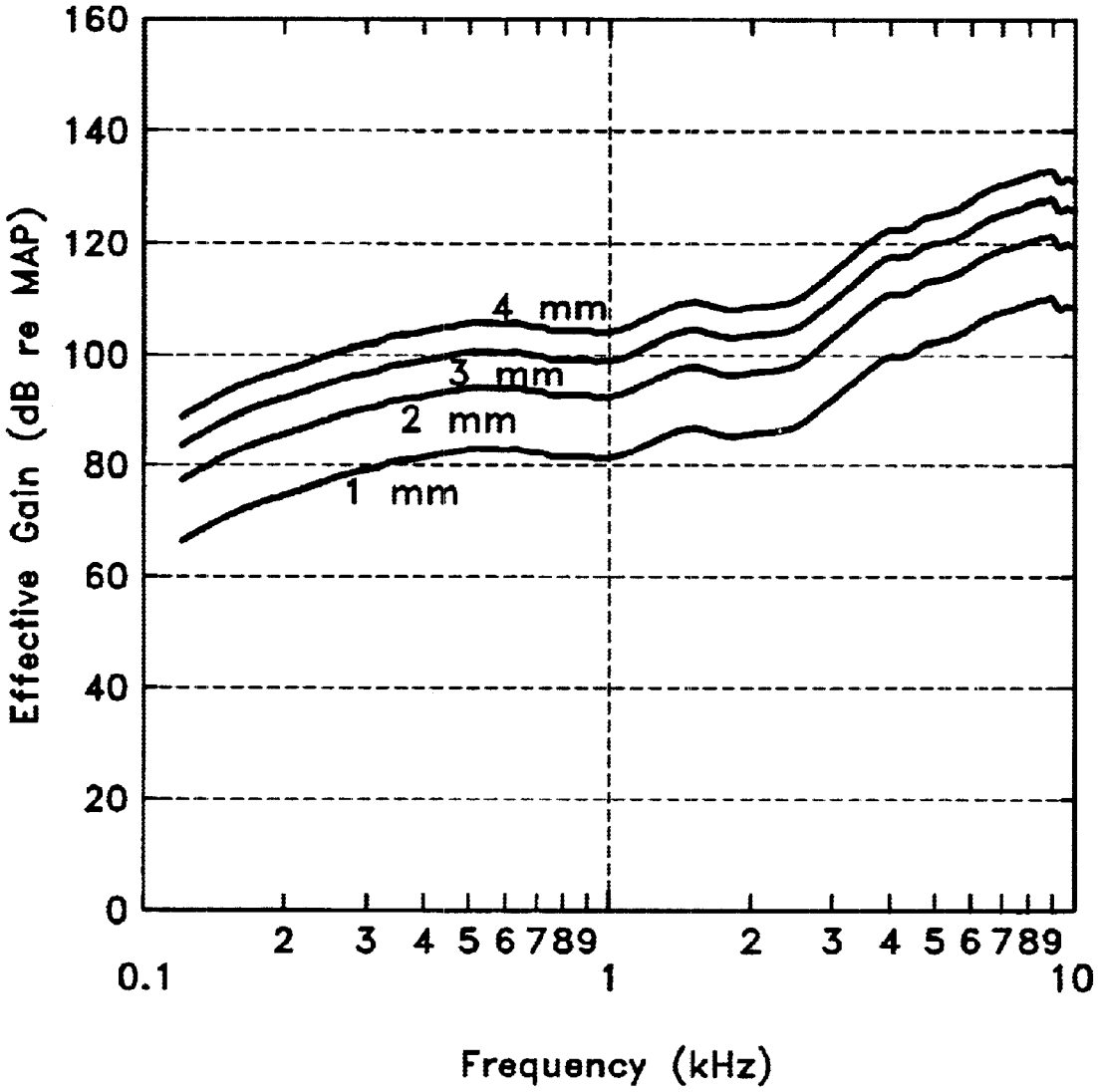

FIG. 6B is a chart of the ratio of the output level of the cymbal actuator to the minimum audible pressure. The ratio is shown in dB. The data is taken from FIG. 6A.

The invention herein is described by examples and a desired way of practicing the invention is described. However, the invention as claimed herein is not limited to that specific description in any manner. Additionally, to the extent that there are variations in the invention which are within the spirit of the disclosure and yet are equivalent to the inventions found in the claims, it is our intent that those claims cover such variations as well.

We claim as our invention:

1. An implantable hearing aid for placement substantially proximate to a middle ear or an inner ear comprising:

a) at least one output actuator comprising a substrate having a first and second opposing surfaces, a thickness, and a transverse size, said substrate being comprised of a material which changes in said thickness and said transverse size upon application of a voltage;

b) a first end cap having a first actuating surface, said first end cap fixedly attached to a portion of a first planar surface where a change in said transverse size of said substrate produces a proportional movement in said first actuating surface in a direction orthogonal to said planar surface; and c) a biocompatible material isolating at least a portion of said output actuator.

2. The implantable hearing aid of claim 1 wherein said substrate has first and second substantially planar surfaces.

3. The implantable hearing aid of claim 1 wherein said substrate is a dome.

4. The implantable hearing aid of claim 1 further comprising at least two spaced apart dome substrates.

5. The implantable hearing aid of claim 1 wherein said output actuator is adapted to be in mechanical communication with auditory fluid of an inner ear.

6. The implantable hearing aid of claim 1 wherein said output actuator is configured for attachment to an incudostapedial joint between a stapes and an incus.

7. The implantable hearing aid of claim 6 wherein said output actuator comprises a first end cap having a shape contoured to receive said incus, and a second end cap having a shape contoured to receive a head of said stapes.

8. The implantable hearing aid of claim 3 wherein said output actuator comprises an inverted-cymbal output actuator.

9. The implantable hearing aid of claim 1 wherein said substrate material is a single-crystal piezo.

10. The implantable hearing aid of claim 1 wherein said substrate is a single crystal and comprises a material selected from the group consisting of solid solutions of lead-zinc-niobate/lead titanate or lead-magnesium-niobate/lead titanate, described by the formulae: $Pb(Zn_{1/3}Nb_2)_{1-x}Ti_xO_3$ or $Pb(Mg_{1/3}Nb_{2/3})_{1-y}Ti_yO_3$; where $0<x<0.10$ and $0<y<0.40$.

11. The implantable hearing aid of claim 1 wherein said actuator comprises a plurality of said substrates, wherein said plurality of substrates are aligned to form a composite substrate having a thickness and a composite transverse size.

12. The implantable hearing aid of claim 1 wherein said output actuator comprises a series of stacked output actuators.

13. The implantable hearing aid of claim 1 wherein said substrate comprises a material selected from the group consisting of PZT, PZLT, PMN, and PMN-PT.

14. The implantable hearing aid of claim 1 wherein said first end cap comprises a shape memory alloy.

15. The implantable hearing aid of claim 1 wherein said first end cap comprises a superelastic alloy.

16. The implantable hearing aid of claim 1 wherein said first end cap comprises a polymeric material.

17. The implantable hearing aid of claim 1 wherein said output actuator has a transverse size less than 6 mm.

18. The implantable hearing aid of claim 2 further comprising a second end cap having a second actuating surface, said second end cap fixedly attached to a portion of said second planar surface where said change in said transverse size of said substrate produces a proportional movement in said second actuating surface in a direction orthogonal to said planar surface.

19. The implantable hearing aid of claim 18 wherein said output actuator is encased within an assembly having a portion adapted for rigid insertion into a bony portion of a promontory, said assembly adapted to having an opening through which said actuating surface of said output actuator is in fluid communication with an inner ear.

20. The implantable hearing aid of claim 1 wherein said output actuator is encased within an assembly having a portion adapted for rigid insertion into a bony portion of a promontory, said assembly adapted to having an opening through which said actuating surface of said output actuator is in fluid communication with an inner ear.

21. The implantable hearing aid of claim 1 wherein said output actuator is adapted to be in mechanical communication with an auditory component of a middle ear.

22. The implantable hearing aid of claim 21 wherein said output actuator is configured for attachment to a stapes.

23. The implantable hearing aid of claim 22 comprising a series of stacked output actuators.

24. The implantable hearing aid of claim 22 wherein said first and second end caps are substantially bowed away from said planar surface.

25. The implantable hearing aid of claim 22 wherein said first and second end caps are substantially bowed towards said planar surface.

26. An implantable hearing aid for placement substantially proximate to a middle ear or an inner ear comprising:

a) at least one output actuator comprising a substrate having a first and second opposing surfaces, a thickness, and a transverse size, said substrate being comprised of a material which changes in said thickness and said transverse size upon application of a voltage;

b) a first end cap having a first actuating surface, said first end cap fixedly attached to a portion of a first planar surface where a change in said transverse size of said substrate produces a proportional movement in said first actuating surface in a direction orthogonal to said planar surface;

c) a biocompatible material isolating at least a portion of said output actuator, wherein said output actuator is adapted to be in mechanical communication with an auditory component of a middle ear, and said output actuator is configured for attachment to a stapes; and d) a spacer adapted to be positioned between said stapes and said output actuator; said spacer comprising a flexible portion, where said flexible portion expands in size from a natural state and maintains an expanded state upon reaching body temperature, wherein said output actuator is secured within said middle ear when said spacer is in said expanded state.

27. The implantable hearing aid of claim 26 wherein said spacer comprises a superelastic alloy.

28. The implantable hearing aid of claim 26 wherein said spacer comprises a shape memory alloy.

29. The implantable hearing aid of claim 26 wherein said output actuator is adapted to be contiguous with a footplate of said stapes.

30. The implantable hearing aid of claim 29 wherein said output actuator has a prismatoid shape.

31. The implantable hearing aid of claim 26 wherein said spacer is positionable within a posterior limb and an anterior limb of said stapes and between a neck of said stapes and said output actuator.

32. The implantable hearing aid of claim 26 wherein a cylinder is placed in contact with a side of said output actuator opposite said spacer, wherein said cylinder is positioned to transmit motion of said output actuator to cochlear fluid through a hole in said footplate.

33. The implantable hearing aid of claim 22 further comprising:

a) an axis along a long side of said stapes, a hole in a footplate of said stapes along said axis; and b) a portion of said output actuator located in said hole.

34. The implantable hearing aid of claim 33 further comprising a first membrane covering said hole, and said portion of said output actuator is placed into said first membrane.

35. The implantable hearing aid of claim 33 wherein said first end cap has a diameter larger than said hole, said end cap having a radial edge which is contiguous with a surface of said footplate.

36. The implantable hearing aid of claim 35 further comprising a second membrane covering said first end cap and said hole.

37. An implantable hearing aid for placement substantially proximate to a middle ear or an inner ear comprising:

a) at least one output actuator comprising a substrate having a first and second opposing surfaces, a thickness, and a transverse size, said substrate being comprised of a material which changes in said thickness and said transverse size upon application of a voltage;

b) a first end cap having a first actuating surface, said first end cap fixedly attached to a portion of a first planar surface where a change in said transverse size of said substrate produces a proportional movement in said first actuating surface in a direction orthogonal to said planar surface;

c) a biocompatible material isolating at least a portion of said output actuator, wherein said output actuator is adapted to be in mechanical communication with an auditory component of said middle ear, and is configured for attachment to a stapes;

d) an axis along a long side of said stapes, a hole in a footplate of said stapes along said axis;

e) a portion of said output actuator located in said hole; and f) a spacer adapted to be positioned between said stapes and said output actuator, said spacer comprising a flexible portion where said flexible portion expands in size from a natural state and maintains an expanded state upon reaching body temperature, and said output actuator is securable within said middle ear when said spacer is in said expanded state.

38. The implantable hearing aid of claim 37 wherein said footplate has a hole covered by a first membrane and said output actuator is placed in said first membrane within said hole.

39. The implantable hearing aid of claim 37 wherein said output actuator has a first end cap sized larger than a hole in said footplate, said output actuator is placed within said hole such that said first end cap is contiguous with said footplate, and said first end cap and said hole are covered by a second membrane.

40. The implantable hearing aid of claim 1 further comprising first and second electrically conductive electrodes each in contact with one of said first and second opposing surfaces.

41. The implantable hearing aid of claim 40 wherein at least one of said first and second electrically conductive electrodes comprise a metal.

42. The implantable hearing aid of claim 41 wherein said metal is sputtered, painted, plated, or deposited on said substrate.

43. The implantable hearing aid of claim 42 wherein at least one of said first and second electrically conductive electrodes covers at least one of said first and second surfaces.

44. The implantable hearing aid of claim 42 wherein at least one of said first and second electrically conductive electrodes covers a portion of at least one of said first and second surfaces.

45. The implantable hearing aid of claim 42 wherein at least one of said first and second electrically conductive electrodes comprise a conductive polymer or polymer blend.

46. The implantable hearing aid of claim 42 wherein said first and second end caps further comprise electrically conductive electrodes.

47. The implantable hearing aid of claim 1 wherein said material comprises a piezoelectric polymer.

48. The implantable hearing aid of claim 47 wherein said piezoelectric polymer comprises PVDF.

49. The implantable hearing aid of claim 1 wherein said biocompatible material isolating said output actuator comprises a polymer or metal.

50. The implantable hearing aid of claim 1 wherein said biocompatible material isolating said output actuator comprises a member selected from the group consisting of titanium, titanium oxide, gold, platinum, and vitreous carbon.

51. The implantable hearing aid of claim 1 wherein said biocompatible material isolating said output actuator comprises a polymeric, metallic or composite bag.

52. An inner ear implant configured for direct mechanical stimulation of fluid in said inner ear comprising:

a) at least one output actuator adapted to be in fluid communication with a fluid, each said output actuator comprises a substrate having a first and second substantially planar surfaces, and a transverse size, said substrate being comprised of a material which changes in said transverse size upon application of a voltage;

b) a first end cap having a first actuating surface, said first end cap fixedly attached to a portion of said first planar surface where a change in said radial size of said substrate produces a proportional movement in said fist actuating surface in a direction orthogonal to said first planar surface;

c) a second end cap having a second actuating surface, said second end cap fixedly attached to a portion of said second planar surface where said change in said transverse size of said substrate produces a proportional movement in said second actuating surface in a direction orthogonal to said second planar surface; and d) a biocompatible material encasing said output actuator.

53. The inner ear implant of claim 52 wherein said fluid is the fluid of the middle ear.

54. The inner ear implant of claim 52 wherein said fluid is an intermediary fluid, wherein a membrane separates said intermediary fluid from the inner ear fluid.

55. A method of improving hearing comprising:

a) providing at least one output actuator comprising i) a substrate having a substantially planar surfaces, and a transverse size, said substrate being comprised of a piezo material, and ii) at least one end cap having an actuating surface, said end cap fixedly attached to a portion of said planar surface where a change in said transverse size of said substrate produces a proportional movement in said actuating surface in a direction orthogonal to said first planar surface;

b) providing a voltage to said substrate to change said traverse size of said substrate and produce said proportional movement of said first actuating surface;

c) positioning said actuator in communication with a portion of an ear to directly transmit said proportional movement of said actuating surface to said portion of said ear.

56. The method of claim 55 wherein said positioning step comprises placing said actuator in contact with a stapes.

57. The method of claim 55 wherein said positioning step comprises placing said actuator in a hole in a footplate of said stapes.

58. The method of claim 55 wherein said positioning step comprises placing said actuator in contact with a incudostapedial joint.

59. The method of claim 55 wherein said positioning step comprises placing said actuator in fluid communication with a fluid of an inner ear.

60. The method of claim 55 wherein said positioning step comprises placing said actuator in fluid communication with an intermediary fluid, said intermediary fluid being hydraulically coupled to the inner ear fluid, and placing a membrane between said intermediary fluid and the inner ear fluid.

61. The method of claim 55 wherein said positioning step comprises placing said actuator in a vestibule fluid space.

* * * * *